US005459944A

United States Patent [19]

Tatsutani et al.

[11] Patent Number: 5,459,944

[45] Date of Patent: Oct. 24, 1995

[54] HAND DRYER

[75] Inventors: Toshio Tatsutani; Tetsuya Tanaka; Toshihiko Horii; Kazuhiko Hotta; Keiu Kawasaki; Keiichi Hasegawa; Yoshiyuki Umai; Masaaki Sendo, all of Gifu, Japan

[73] Assignee: Mitsubishi Denki Kabushiki Kaisha, Tokyo, Japan

[21] Appl. No.: 110,803

[22] Filed: Aug. 23, 1993

[30] Foreign Application Priority Data

| | | | |
|---|---|---|---|
| Aug. 25, 1992 | [JP] | Japan | 4-225848 |
| Aug. 25, 1992 | [JP] | Japan | 4-225849 |
| Aug. 25, 1992 | [JP] | Japan | 4-225850 |
| Aug. 25, 1992 | [JP] | Japan | 4-225851 |
| Aug. 25, 1992 | [JP] | Japan | 4-225852 |
| Aug. 25, 1992 | [JP] | Japan | 4-247186 |
| Jan. 20, 1993 | [JP] | Japan | 5-7824 |

[51] Int. Cl.[6] ..... F26B 19/00

[52] U.S. Cl. ..... 34/202; 34/565; 34/572; 392/380

[58] Field of Search ..... 34/202, 90, 91, 34/54, 55, 487, 565, 572; 392/380

[56] References Cited

U.S. PATENT DOCUMENTS

| | | | |
|---|---|---|---|
| 3,305,938 | 2/1967 | Goldstein | 34/44 |
| 3,643,346 | 2/1972 | Lester | 34/202 |
| 3,766,397 | 10/1973 | Rockson | 34/202 |
| 4,087,925 | 5/1978 | Bienek | 34/202 |
| 4,336,619 | 6/1982 | Hinkel et al. | 34/90 |
| 5,146,695 | 9/1992 | Yang | 34/202 |
| 5,186,360 | 2/1993 | Mease et al. | 34/90 |

FOREIGN PATENT DOCUMENTS

| | | | |
|---|---|---|---|
| 548998 | 4/1932 | Germany . | |
| 2018695 | 10/1971 | Germany . | |
| 63-154138 | 6/1988 | Japan . | |
| 2-23918 | 1/1990 | Japan . | |
| 371571 | 10/1963 | Switzerland | 34/202 |
| 909069 | 10/1962 | United Kingdom | 34/202 |
| 1240242 | 7/1971 | United Kingdom | 34/202 |
| 2249026 | 4/1992 | United Kingdom . | |

*Primary Examiner*—Denise L. Gromada

[57] ABSTRACT

A hand dryer in which a channel-like hand insertion unit 5 opening at the front face and side faces is formed in the front face of a case 6 which functions as an outer shell. Upper and lower blowout nozzles 32 and 33 are disposed in the upper and lower faces of the hand insertion unit 5. A high-pressure air flow generation device 7 supplies high-pressure air flow to the blowout nozzles 32 and 33. A high-speed wind generated in the hand insertion unit 5 blows water on hands to the inner portion of the hand insertion unit 5. The blown water is drained to the outside of the hand insertion unit 5, through drainage holes 18 which are disposed at lateral ends of the bottom face of the hand insertion unit 5. Thereby, the blown water from the hands can be smoothly drained without remaining in the hand insertion unit.

32 Claims, 18 Drawing Sheets

HAND DRYER

BACKGROUND OF THE INVENTION

This invention relates to a hand dryer for sanitarily drying a wet hand after washing.

In order to keep hands sanitary, a process of washing hands and a process of drying hands after washing must sanitarily be conducted. To comply with this, used is a hand dryer by which wet hands after washing can directly be dried, such as that disclosed in Unexamined Japanese Patent Publication (Kokai) Hei-2-23918.

As shown in FIG. 30, the prior art hand dryer disclosed in the publication comprises air blowing means consisting of an induction motor 1 and vanes 2 rotated by the motor, and heating means consisting of an electric heater 3. In the air blowing means, the scirocco type vanes 2 are rotated to generate an air flow which is to be blown to a hand drying unit 4. The electric heater 3 heats the air flow which is generated by the air blowing means and is to be blown to the hand drying unit 4, whereby the air flow is converted into a hot blast.

In the thus configured hand dryer, when wet hands are put in front of the hand drying unit 4 from which a hot blast is blown out, the hands are sanitarily dried. In other words, water on the hands exposed to the hot blast is evaporated by the heat so as to be removed from the hands.

In such a conventional hand dryer, since hands are directly exposed to a hot blast, the temperature of the hot blast is set to be a relatively low temperature. Therefore, the drying process requires a prolonged period, and it is cumbersome to use such a hand dryer.

The hand drying unit 4 from which a hot blast is blown out is opened to the exterior. When hands are put to the hand drying unit 4, therefore, the hot blast and the water from the hands are blown toward the user, thereby sometimes giving the user an unpleasant feeling. Furthermore, the water from the hand are splashed on the floor so that the floor is soiled.

The above-mentioned inconvenience may be solved by an improvement such as that a barrier is formed in the hand drying unit 4 or that the hand drying unit 4 is enclosed except one portion. However, such improvements produce other problems in that the barrier causes the hand dryer to become inconvenient to use, and that water is collected in the enclosure owing to the drying process. Moreover, when a drying process is conducted under the state where the user inserts the hands, which are parts of the body, into such a closed space and the user cannot see the hands well, the user is often caused to instinctively feel uneasy, thereby making the hand dryer hard to use.

SUMMARY OF THE INVENTION

This invention has been conducted in order to solve the above-mentioned problems, and has an object of providing a hand dryer which can easily conduct a process of rapidly drying a hand, and which is sanitary and easy to use.

It is another object of the invention to prevent water which has been separated from a hand from splashing toward the user or the floor. It is a further object of the invention to reduce the sound level due to the generation of a high-pressure air flow. It is a still further object of the invention to treat water inside a hand dryer. It is a further object of the invention to provide a hand dryer which is convenient to use and which can be prevented from erroneously operating.

A hand dryer according to the invention comprises a case; a hand insertion unit which is disposed in said case, which opens at the front and side faces of said case, and into which hands can obliquely be inserted through the opening, said unit having a size sufficient for accommodating hands; a high-pressure air flow generation device which is disposed in said case, and which has a fan for generating a high-pressure air flow; and nozzles which are respectively disposed in two faces of said hand insertion unit, said faces opposing to each other, said nozzles communicating with an air flow path of said high-pressure air flow generation device.

According to the hand dryer of the invention, a high-pressure air flow can be blown from the two faces in the case to both sides of a hand. Therefore, the process of drying hands can be conducted within a short period while preventing water from scattering and splashing toward the user. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF PREFERRED EMBODIMENTS

First, the basic configuration of a hand dryer according to an embodiment of the invention will be described with reference to the drawings, and then the configurations of the details will be sequentially described with reference to the drawings.

Figure 1:
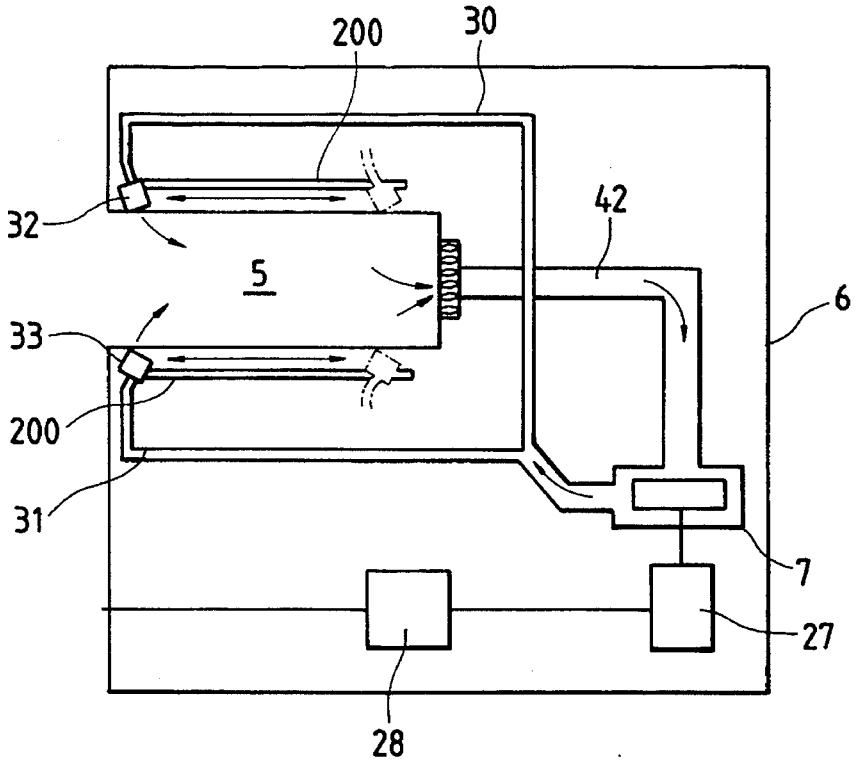
FIG. 1 is a diagrammatic view showing the whole of a hand dryer according to an embodiment of the invention.

FIG. 1 is a side view diagrammatically showing the configuration of a hand dryer according to an embodiment of the invention. In FIG. 1, reference numeral 6 is a case, 32 and 33 are nozzles formed in the case 6, and 7 is a high-pressure air flow generation device formed in the case 6. The high-pressure air flow generation device 7 comprises a driving circuit 28 for driving DC brushless motors 27, turbo fans rotated by the respective DC brushless motors 27, and air ducts 30 and 31 respectively communicated with the nozzles 32 and 33. The high-pressure air flow generation device 7 can produce an air flow blowing out the nozzles at a speed of about 25 to 100 m/sec.

In the thus configured hand dryer, the DC brushless motors 27 are driven by the driving circuit 28 so as to rotate at a high speed greater than the synchronous rotation number of the commercial power supply, and a high-speed air flow having a higher kinetic energy is generated by the turbo fans. As shown by arcuate arrows, the high-speed air flow circulates in the case 6.

When wet hands after washing are placed before the nozzles 6, water on the hands is blown away by the high-speed air flow, and the hands are dried after several seconds (from 5 seconds to 8 seconds at the longest).

In this way, a hand dryer can be obtained in which a process of drying wet hands can be terminated within a short period and without bothering the user to move or open the hands, which can rapidly and surely conduct a drying process, and which can be used easily and simply without causing a troublesome sense.

Moreover, the hand dryer has a configuration which does not use heat energy, and therefore it does not require heating means such as an electric heater, and a configuration relating to a temperature control, whereby the production cost and operation cost can be reduced.

The nozzles 32 and 33 shown in FIG. 1 are provided with a moving mechanism 200 so that they can slidingly move in the directions of straight arrows.

The configuration of the embodiment will be further described in detail.

Figure 5:
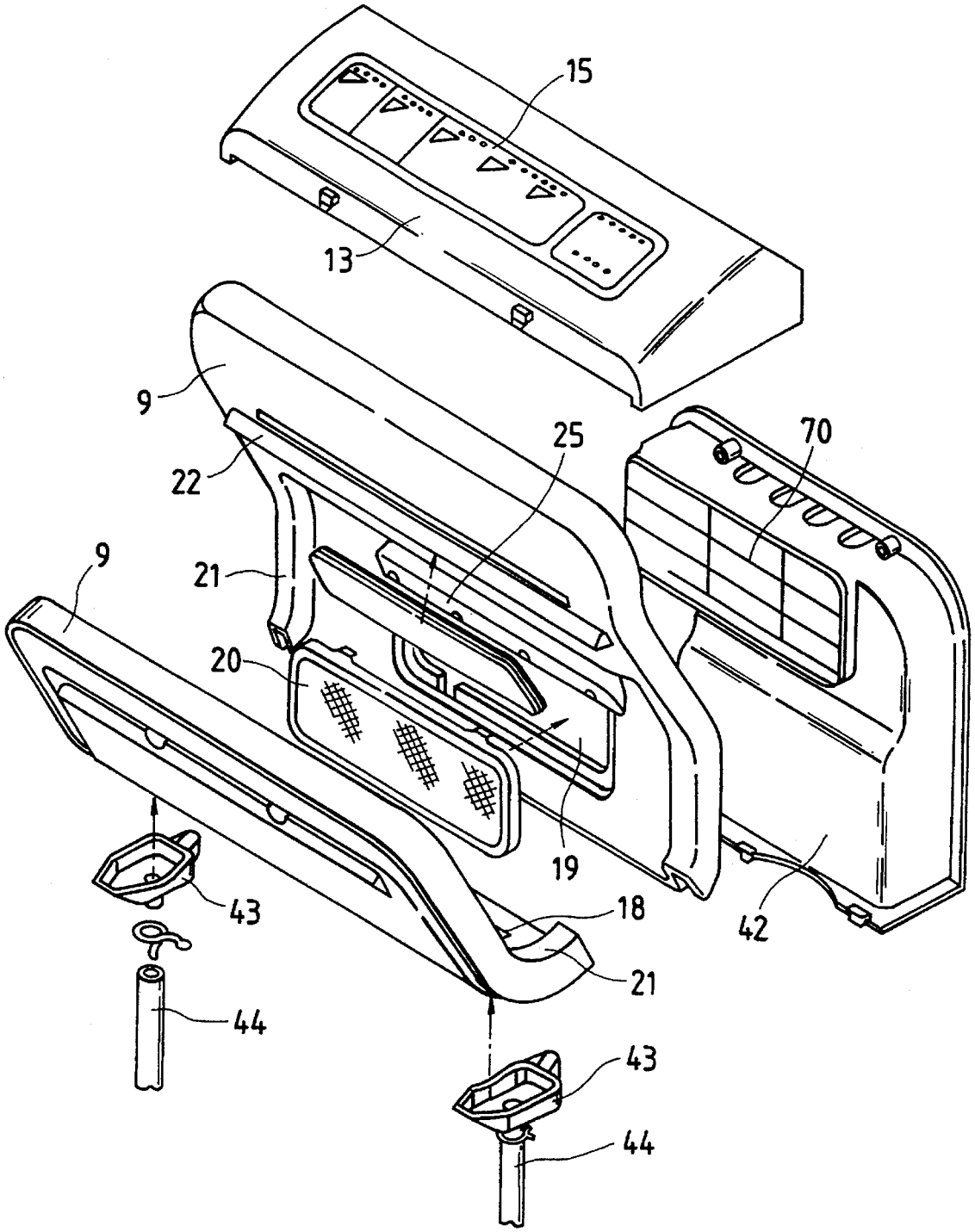
FIG. 5 is an exploded perspective view showing on an enlarged scale a portion of the configuration of a case of the hand dryer according to the embodiment of the invention.
Figure 6:
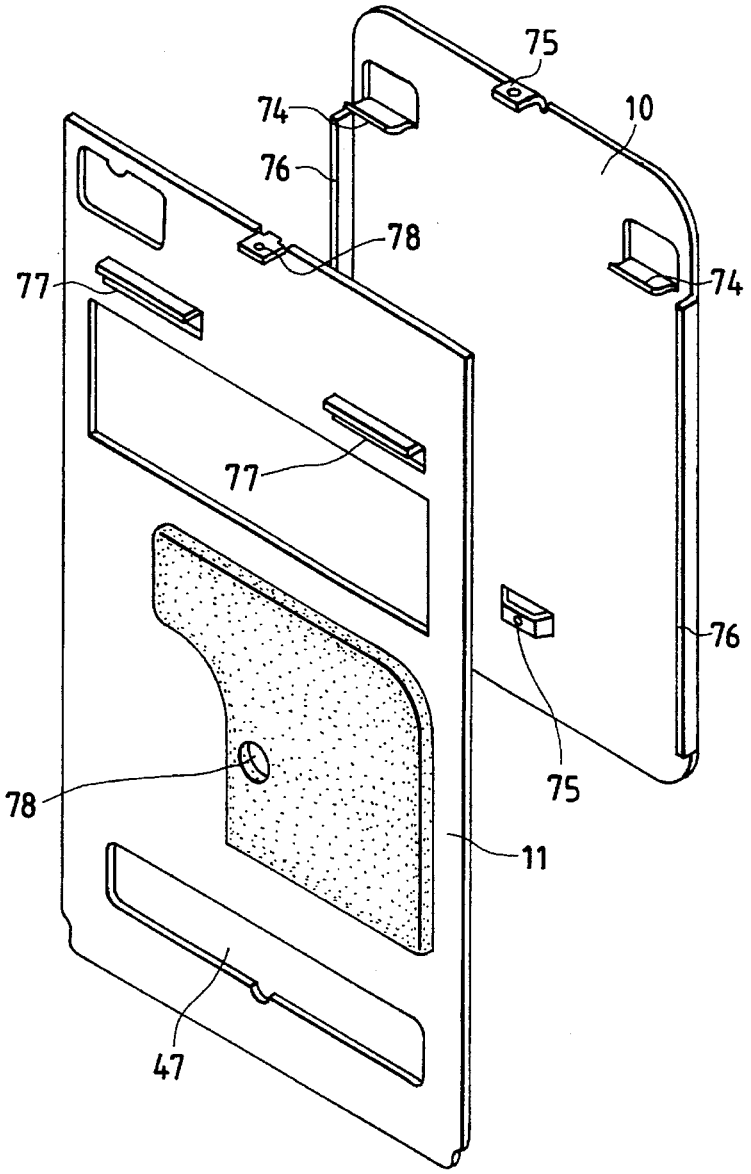
FIG. 6 is an exploded perspective view showing on an enlarged scale a portion of the configuration of the case of the hand dryer according to the embodiment of the invention.
Figure 7:
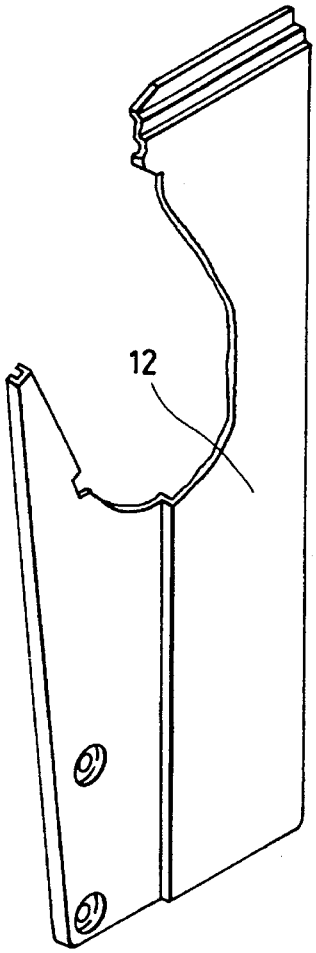
FIG. 7 is a perspective view showing on an enlarged scale one of the side plates of the case of the hand dryer according to the embodiment of the invention.
Figure 8:
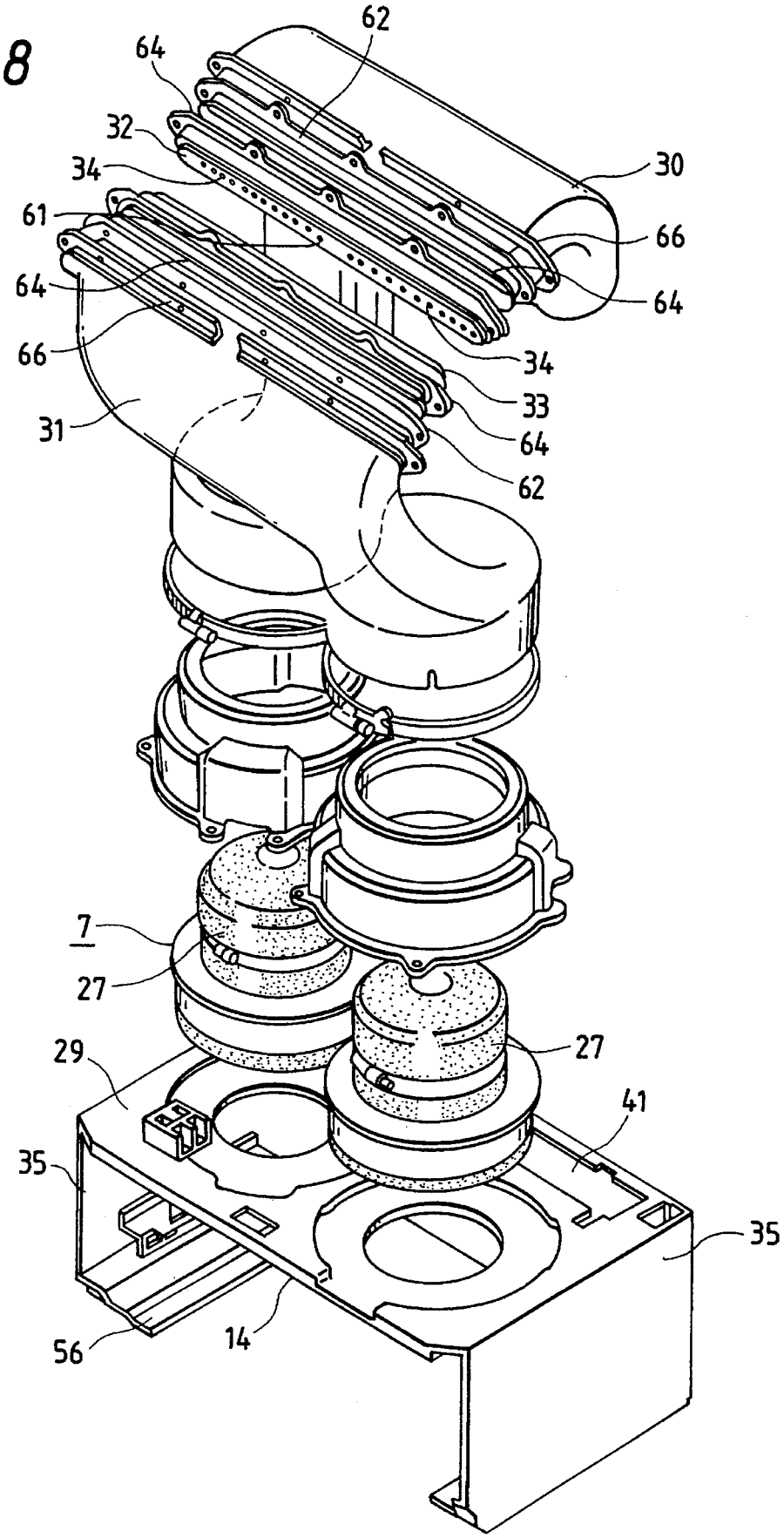
FIG. 8 is an exploded perspective view showing on an enlarged scale the configuration relating to a high-pressure air flow generation device of the hand dryer according to the embodiment of the invention.

The front of the case 6 which functions as an outer shell of the hand dryer comprises a front panel 8, and upper and lower insertion unit panels 9 which constitute a hand insertion unit 5 as shown in FIG. 5. The rear of the case 6 comprises, as shown in FIG. 6, a rear plate 11 which is provided with a mounting structure for a wall mounting plate 10. Each of the left and right sides of the case 6 comprises a side plate 12 (see FIG. 7). The upper face of the case 6 consists of an upper panel 13 shown in FIG. 5, and the bottom comprises a portal frame 14 as shown in FIG. 8. The upper panel 13 of the case 6 is detachably mounted. On the front portion of the panel, attached is a display unit 15 (FIG. 26) for displaying operation procedures and abnormal states. A mounting plate 16 is disposed inside the case and under the upper panel 13, and electric parts 17 such as a reactor for improving the power factor are mounted to the mounting plate 16.

Figure 2:
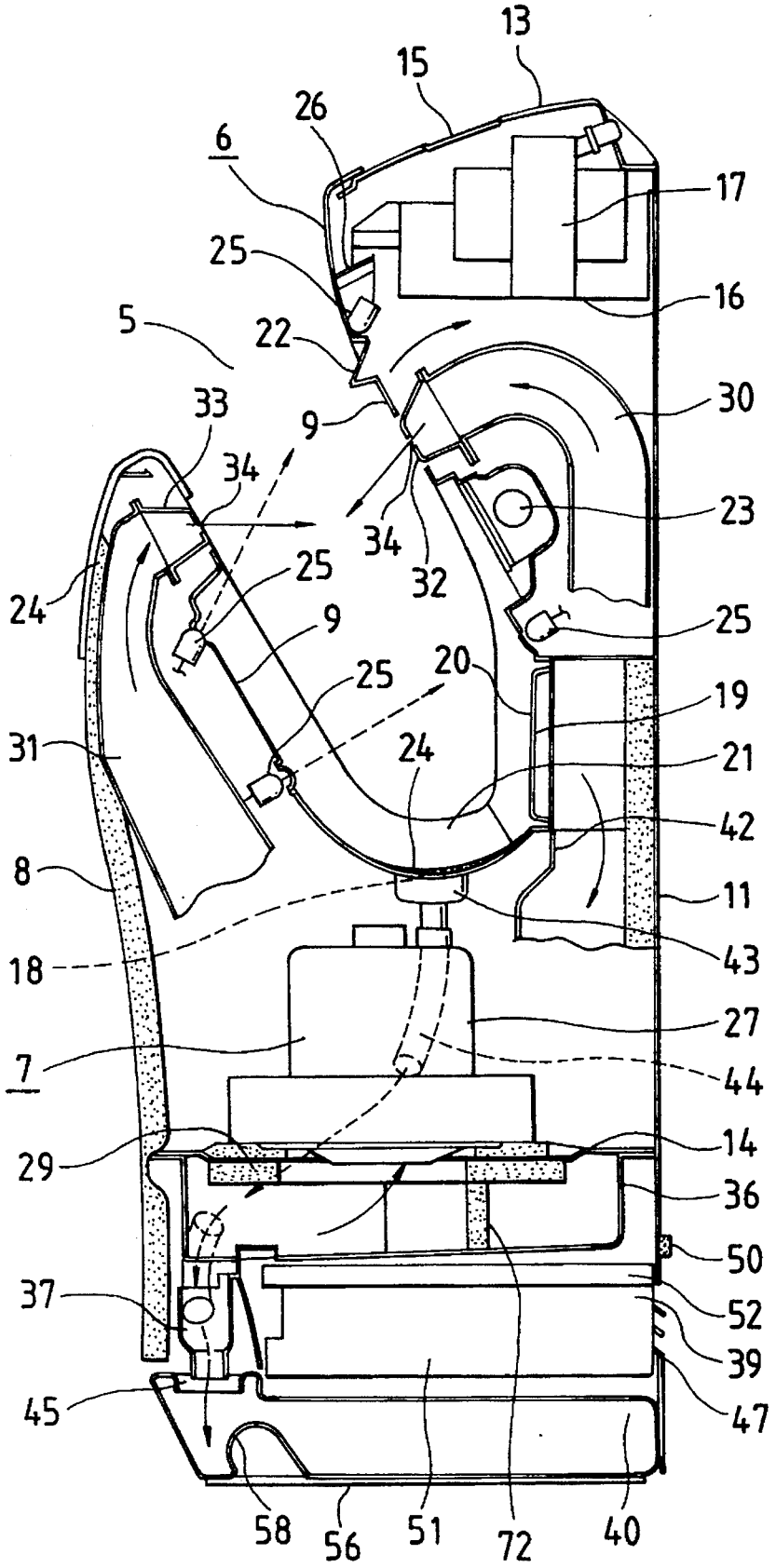
FIG. 2 is a longitudinal cross sectional side view showing the whole of the hand dryer according to the embodiment of the invention.
Figure 4:
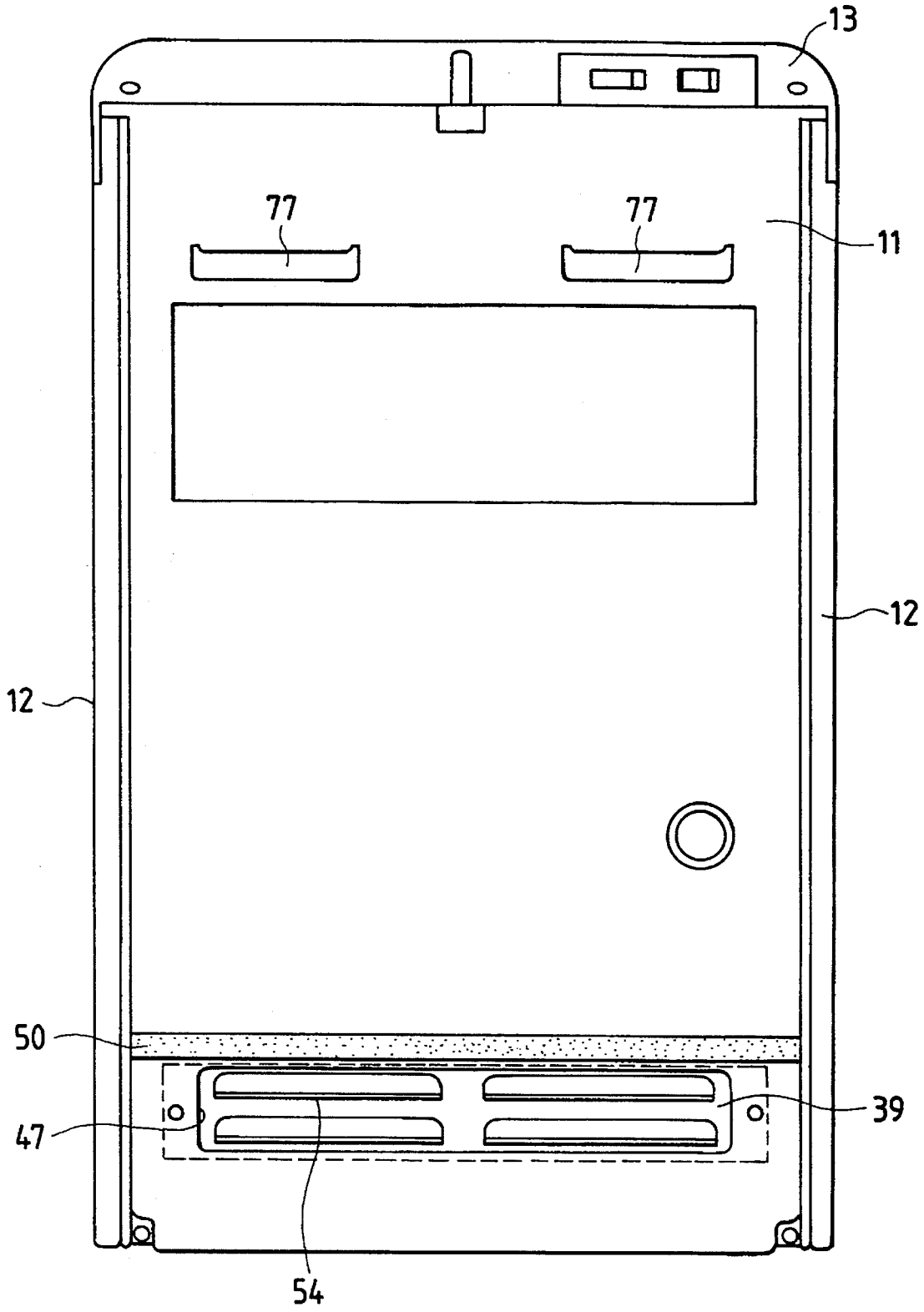
FIG. 4 is a rear view showing of the hand dryer according to the embodiment of the invention.

The hand insertion unit 5 constituted by the upper and lower insertion unit panels 9 is constructed at the upper portion of the front of the case 6, in the form of a U-shaped channel-like oblique recess portion which opens at the front and the left and right sides and which is downward inclined toward the inner portion. The hand insertion unit 5 has a sufficient width, height and depth, so that the user does not feel a sense of incongruity or uneasiness under the state where the user naturally puts both hands into the unit and, and that the user can freely insert or remove the hands into or from the hand insertion unit 5 while seeing the hands. A drain hole 18 is formed at each side end of the bottom of the hand insertion unit, and a rectangular air inlet 19 is formed on the inner face. The air inlet 19 is located at a center and slightly upper position of the innermost face so that water cannot enter the air inlet (FIG. 2). A mesh filter 20 is detachably attached to the air inlet 19, whereby foreign materials such as a paper sheet, a handkerchief, and the like are prevented from being erroneously sucked in the air inlet.

Figure 12:
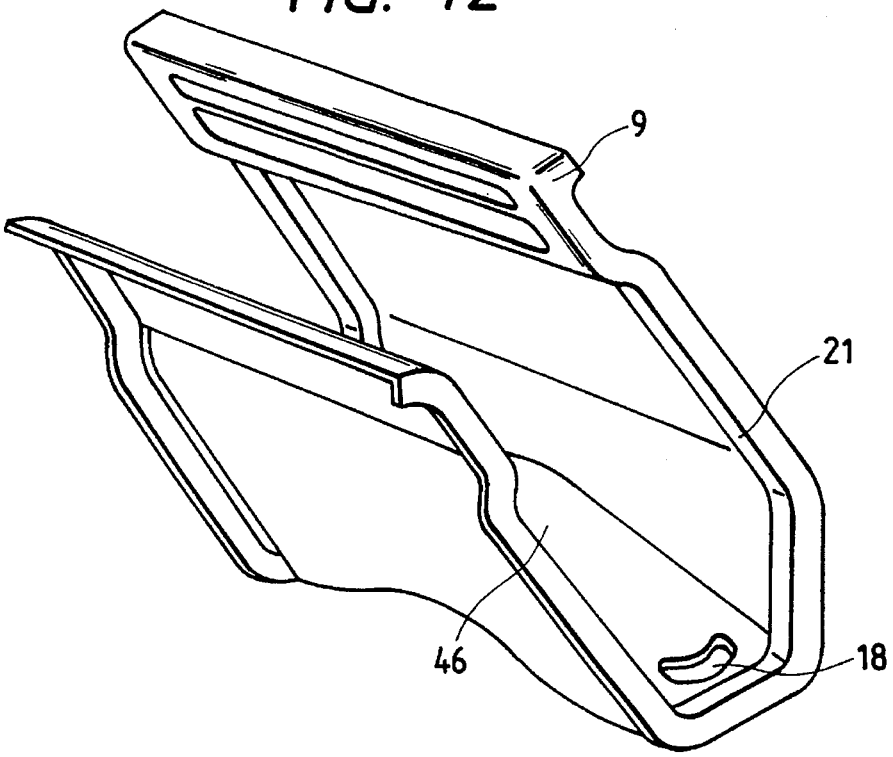
FIG. 12 is a partial perspective view of a hand insertion unit.

The inner portion of the hand insertion unit 5 is larger than the inlet portion. At the inner periphery of each of the opening portions in the both sides of the hand insertion unit 5, a flange 21 inwardly extending is formed in the form of a bank so that water and air flow are prevented from being laterally scattered and ejected. In order to improve the touch, the whole of the periphery of the opening of the hand insertion unit 5 is formed so as to have a smooth round shape. A water-repellant coating material is applied to the inner face of the hand insertion unit 5 to give the water repellency to the inner face, so that waterdrops and dirt are prevented from sticking to the inner face. FIG. 12 shows another embodiment. A windshield projection 22 which is a protruding member for preventing wind from bouncing is formed on the upper face portion of the inlet of the hand insertion unit 5 in such a manner that it is integrated with the upper insertion unit panel 9. At a further inner position between the projection 22 and the air inlet 19, a germicidal lamp 23 is disposed in such a manner that the eyes of the users are not directly irradiated with ultraviolet rays.

Sanitary sheets 24 which can easily be replaced with new ones are disposed on the inner bottom face of the hand insertion unit 5, and on a portion continuing from the inlet portion of the hand insertion unit 5 to the front panel 8 (see FIG. 2). The sanitary sheets 24 consist of nonwoven fabric or the like which has hydrophilic and water absorption properties, and which have been subjected to a sanitary treatment such as an antibacterial treatment. The sanitary sheets 24 can prevent the inlet portion of the hand insertion unit 5 and the upper side portion of the front panel 8, from being moistened and stained by waterdrops dripping from hands or the like which have not yet subjected to the drying process, and also prevent the splash of water at the bottom portion of the hand insertion unit 5 in a drying process, from occurring. Furthermore, by replacing the sanitary sheets 24 with new ones, these portions can be kept clean.

As shown in FIG. 2, sensors 25 for detecting insertion and withdrawal of hands into and from the hand insertion unit 5 are attached to the inlet and inner portions of the hand insertion unit 5, respectively, so as to be separated from each other by a distance of about 10 to 15 cm. In the embodiment, each of the sensors 25 consists of a plurality of infrared light emitting elements such as LEDs which are laterally arranged, and a plurality of infrared light receiving elements such as phototransistors which are laterally arranged. The light emitting units are on the wall of the lower portion, and the light receiving units are on the wall of the upper portion which is less affected by external light. The sensor 25 attached on the wall of the upper portion in the inlet side is covered by a water guard projection 26 which functions also as a rib and which is laterally formed on the back face of the upper insertion unit panel 9, so that the sensor is protected against water entry from the removable upper panel 13. When both the infrared light beams from the infrared light emitting elements at the inlet and inner portions are intercepted to hinder the infrared light receiving elements from receiving the light beams, a hand detection signal is generated so that the high-pressure air flow generation device 7 is operated by a control circuit. In contrast, when both the infrared light beams from the infrared light emitting elements at the inlet and inner portions are received by the infrared light receiving elements, a hand-nonexistence detection signal is generated to stop the operation of the high-pressure air flow generation device 7. In order to prevent a malfunction or misuse due to dust adhering to the sensors 25 from occurring, when the high-pressure air flow generation device 7 is continuously operated for a period longer than a given period, it is automatically stopped by a timer or the like.

As shown in FIG. 8, the high-pressure air flow generation device 7 consists of the DC brushless motors 27 (alternatively, conventional commutator motors may be used), the driving circuit 28 for driving the motors (see FIG. 25), and the turbo fans (not shown) rotated by the respective DC brushless motors 27. In the embodiment, two sets of the motor and the fan are mounted in a parallel manner on a flat portion 29 of the frame 14 in the case 6, so that their air intakes are downward directed to enable the air suction. The suction side of the high-pressure air flow generation device 7 is connected through an air intake duct to the air inlet 19 which is formed at the inner portion of the hand insertion unit 5, so that the air in the hand insertion unit 5 can be sucked in.

As shown in FIG. 8, ends of the upper and lower air ducts 30 and 31 are respectively connected to the DC brushless motors 27 sides which are the air outlets of the high-pressure air flow generation device 7. The other ends of the upper and lower air ducts 30 and 31 are extended into a flattened trumpet-like shape and have a slit-like open end which laterally elongates. The upper and lower blowout nozzles 32 and 33 are attached to the slit-like open ends, respectively. In the upper and lower blowout nozzles 32 and 33, a plurality of nozzle holes 34 are formed in a row so that the high-pressure air flow sent from the high-pressure air flow generation device 7 is blown out through the nozzle holes as a wind of a velocity of 50 to 150 m/sec (see the enlarged section view of FIG. 10).

The upper blowout nozzle 32 is attached laterally and downward to the upper portion of the inlet of the hand insertion unit 5, and the lower blowout nozzle 33 is attached laterally and upward to the lower portion of the inlet of the hand insertion unit 5. The nozzles are inclined so that a pressure gradient directed from the inlet toward the inner portion is produced. This allows the wind to be simultaneously blown against both the back and palm of hands inserted into the hand insertion unit 5, thereby removing waterdrops from the front and rear of the hands without necessitating rubbing the hands together.

Figure 18:
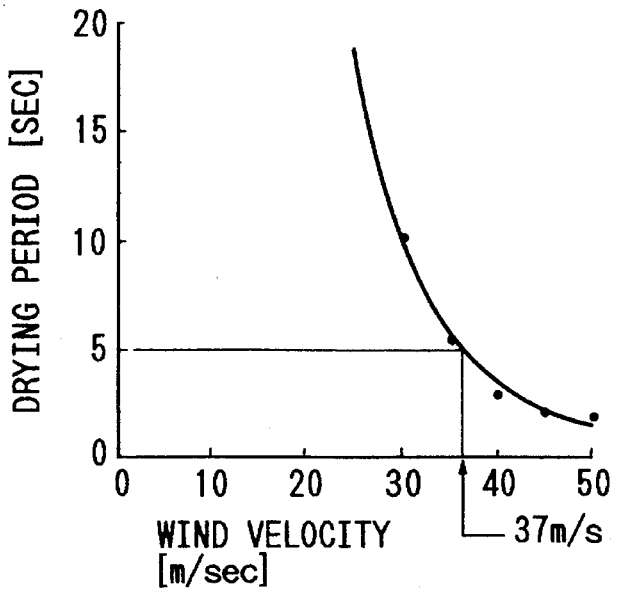
FIG. 18 is a graph showing a characteristic curve between a drying period and a wind velocity in the hand dryer according to the embodiment of the invention.
Figure 20:
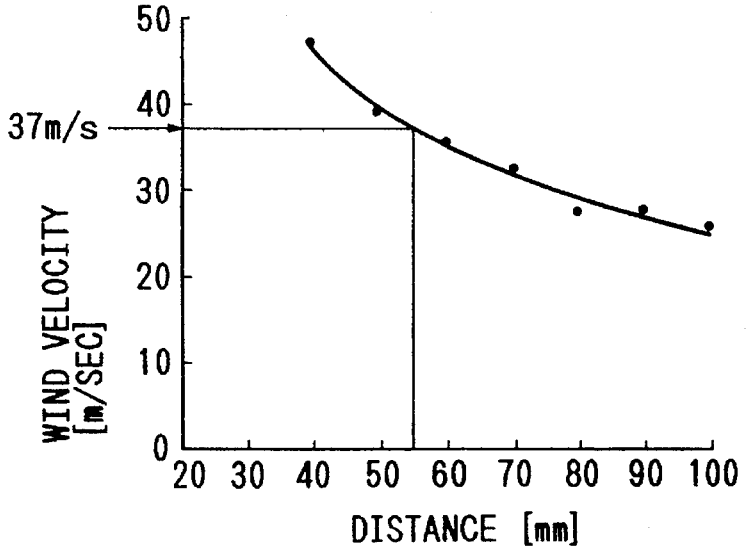
FIG. 20 is a graph showing a characteristic curve between a wind velocity and a distance between upper and lower nozzles in the hand dryer according to the embodiment of the invention.

The hand dryer of the invention can shorten the drying period. FIG. 18 shows the relationship between the drying period and the wind velocity in the hand dryer. When the drying period is set to be 5 seconds or shorter in the invention wherein evaporation of water due to heat is not expected and water is blown away by a wind, as seen from FIG. 18, the wind velocity must be 37 m/s or more. In the view point of drying, it is preferable to set the distance between the upper and lower blowout nozzles 32 and 33 to be a value as small as possible. When considering the required wind velocity with relation to the distance between the upper and lower blowout nozzles 32 and 33, however, the minimum distance between the upper and lower blowout nozzles 32 and 33 can be determined from the graph of FIG. 20, or the minimum distance is about 9 to 11 cm.

Figure 19:
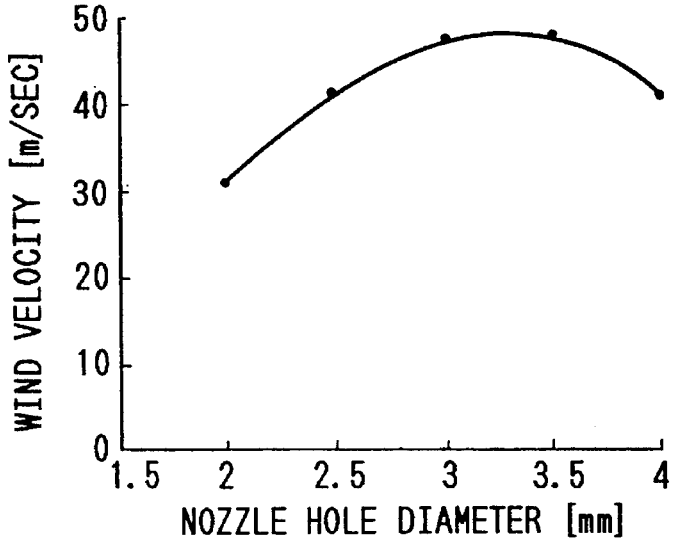
FIG. 19 is a graph showing a characteristic curve between a wind velocity and a nozzle hole diameter in the hand dryer according to the embodiment of the invention.

When the diameter of the nozzle holes 34 is represented by x [mm] and a wind velocity at a position separated from the nozzle 32 (33) by 50 mm is represented by y [m/sec], the relationship between the hole diameter and the wind velocity can be expressed by $y=-2x^3+7x^2-19x-19$ as shown in FIG. 19.

Figure 9:
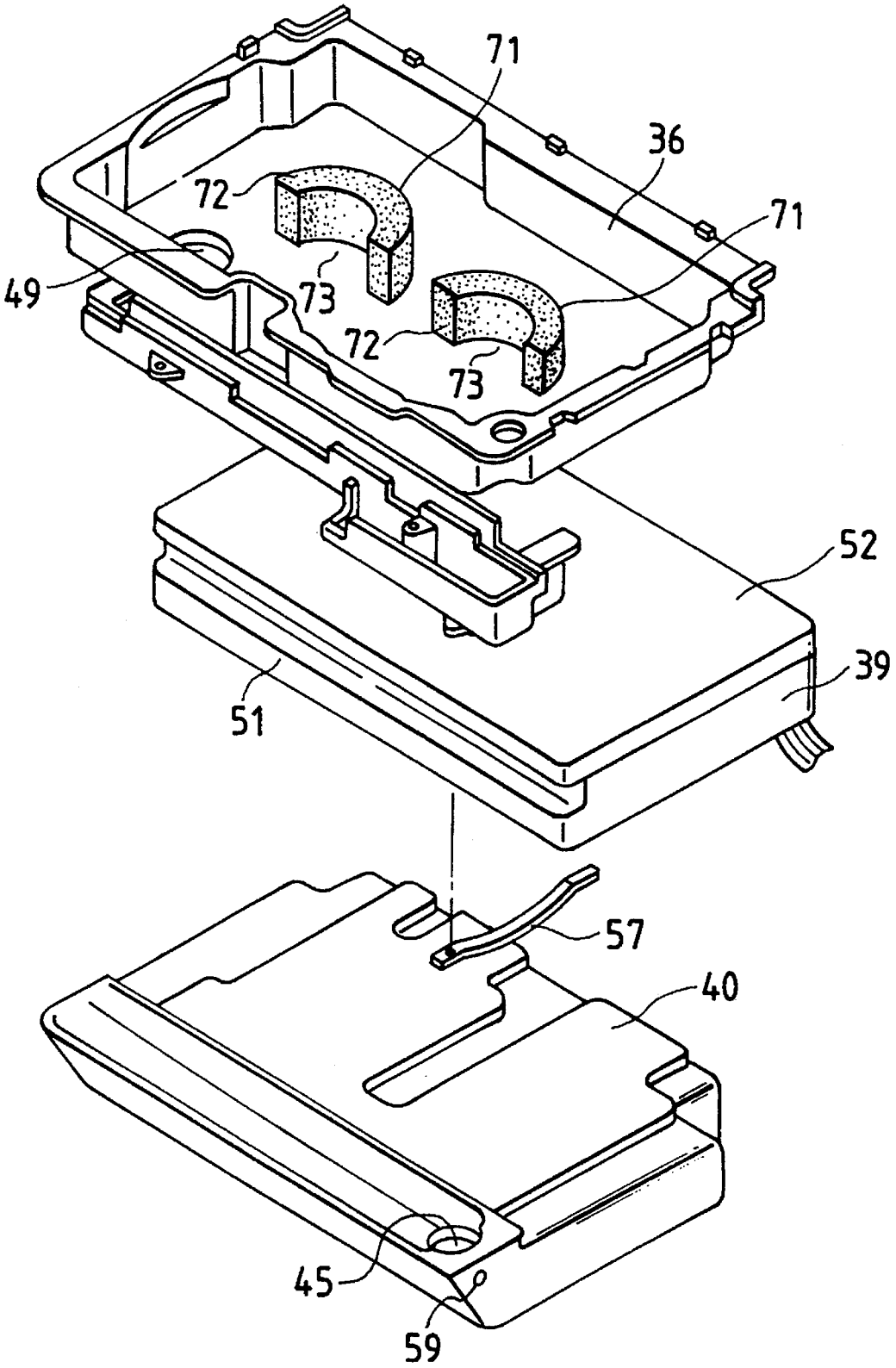
FIG. 9 is an exploded perspective view showing on an enlarged scale the configuration of a frame of the hand dryer according to the embodiment of the invention.

As shown in FIGS. 8 and 9, between side legs 35 of the portal frame 14 onto which the high-pressure air flow generation device 7 is mounted, a first air guide 36 constituting one portion of the inlet air duct, a drain pan 37, a circuit box 39 wherein the circuit unit 38 of the control circuit is housed, and a drain tank 40 are arranged in a descending order.

The first air guide 36 is attached to the back face of the flat portion 29 of the frame 14 and cooperates with the flat portion 29 to form an air flowing space. Openings 41 are formed at the left and right areas of the rear side portion of the flat portion 29 of the frame 14. The air inlet 19 of the hand insertion unit 5 is communicated with the openings 41 through a second air guide 42. Namely, the inlet of the high-pressure air flow generation device 7 is connected to the air inlet 19 of the hand insertion unit 5 through an air inlet path which is composed of the openings 41 of the frame 14 and the first and second air guides 36 and 42.

Funnel-shaped drain pieces 43 are respectively mounted on the back sides of drainage holes 18 which are formed at the both side ends of the hand insertion unit 5. Left and right drain hoses 44 are respectively connected at one end to the drain pieces 43, and the other ends of the drain hoses 44 are opened in the drain pan 37 so as to accomplish the drainage. In the bottom of the drain pan 37, formed is a drainage connecting port which engages with a faucet 45 formed on the upper face of the drain tank 40 so as to accomplish the drainage. A series of drainage paths in which the both drainage holes 18 of the hand insertion unit 5 are used as inlets and the drain tank 40 is used as an outlet is configured so that the allowable flow rate of water is gradually increased as water moves through the paths including the connecting portions toward the outlet.

In the hand dryer having the above-described basic configuration, when wet hands are inserted into the hand insertion unit 5, water on the hands is blown away toward the inner portion of the hand insertion unit 5 by a high-speed wind produced in the unit 5, thereby rapidly conducting a drying treatment under the state where the user can see the hands so as not to feel a sense of uneasiness.

Namely, when wet hands are inserted into the hand insertion unit 5 and both the infrared light beams from the infrared light emitting elements at the inlet and inner portions are intercepted to hinder the infrared light receiving elements from receiving the light beams, a hand detection signal is generated. Then, the control circuit causes the DC brushless motors 27 of the high-pressure air flow generation device 7 to start to rotate, whereby the turbo fans are rotated. By the rotation of the turbo fans, the air in the hand insertion unit 5 is drawn from the air inlet 19 into the high-pressure air flow generation device 7 through the air inlet path composed of the first and second air guides 36 and 42, thereby generating a high-pressure air flow. The high-pressure air flow is sent from the outlet of the high-pressure air flow generation device 7 into the upper and lower air ducts 30 and 31, and then blown out from the upper and lower blowout nozzles 32 and 33 to be simultaneously hit against both the back and palm of the hands as a high wind and with a predetermined inclination. Waterdrops on the hands are blown away by the high-speed wind in the forward direction, or toward the inner portion of the air in the hand insertion unit 5.

The blown waterdrops are pushed by both gravity and wind to the end of the bottom of the hand insertion unit 5, and flow into the drain hoses 44 from the drainage holes 18 formed in the bottom, so as to be sequentially and smoothly drained from the hand insertion unit 5. Water which has flown through the drain hoses 44 is collected in the drain pan 37, and then enters the drain tank 40 at the lowest portion. In an open vessel, generally, a drainage hole is formed at the center of the bottom of the vessel, and the bottom is inclined so as to be downward directed to the drainage hole. In the hand insertion unit 5 of the hand dryer wherein a wind is blowing so as to compete with the action of gravity, however, water at the periphery portion is difficult or occasionally impossible to move to the center portion wherein the wind is hardly blowing. Even if a drainage hole is formed at the center, therefore, it cannot be expected to smoothly conduct drainage. In the embodiment, however, the drainage holes 18 are formed at both ends of the bottom at the inner portion, and hence water impelled to the periphery portion can be smoothly drained. When a large amount of water is collected in the drain tank 40, the drain tank 40 is drawn out from the space between the legs 35 of the frame 14, and, after the water is disposed, the drain tank 40 is again mounted to be reused.

On the other hand, the air blown out from the upper and lower blowout nozzles 32 and 33 is again sucked from the air inlet 19 disposed at the inner portion of the hand insertion unit 5, into the high-pressure air generation flow device 7, and circulated to be reused for the drying process. In this case, since the air inlet 19 is located at the center of the inner portion, the pressure of the vicinity of the inlet of the hand insertion unit 5 is reduced. Accordingly, the wind does not reversely blow, the velocity of the wind blowing from the upper and lower blowout nozzles 32 and 33 is not reduced, and air flows at the left and side portions of the hand insertion unit 5 are well balanced.

In this way, the wet hands are dried within about 5 seconds. When the hands are withdrawn from the hand insertion unit 5, the hand-nonexistence detection signal is generated to stop the high-pressure air flow generation device 7 after the elapse of a fixed period, thereby completing the rapid and sanitary treatment of drying hands. In other words, according to the hand dryer, hands can be dried easily, simply and sanitarily without accompanying troublesome, cumbersome, incongruent and uneasy senses. The operation control using the sensors 25 will be described later.

Although dirt on the surface of the case 6 and the inner face of the hand insertion unit 5 can be removed by a simple wiping procedure, the use environment of the dryer is apt to cause the hand insertion unit 5 to be cleaned using a relatively large amount of water. Even in such a case, water can smoothly be drained because the series of drainage paths starting from the both drainage holes 18 is configured so that the allowable flow rate of water is gradually increased as water moves through the paths including the connecting portions toward the outlet. This prevents a trouble such as that a leak occurs in the hand dryer, from arising.

Figure 11:
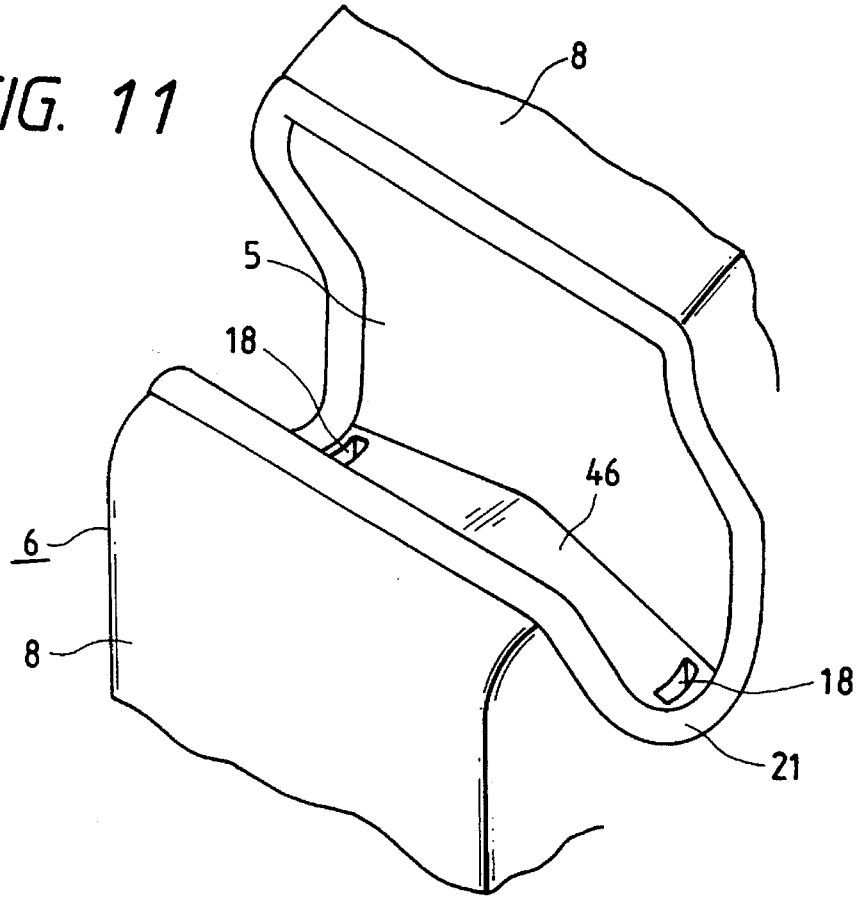
FIG. 11 is a partial diagrammatic perspective view showing another embodiment relating to a hand insertion unit of the hand dryer according to the embodiment of the invention.

It is not necessary to form the drainage holes 18 of the hand insertion unit 5 at the both side end portions. A single drainage hole may be formed only at one end portion. When the bottom at the inner portion of the hand insertion unit 5 is provided with a gentle slope which is downward directed to the drainage hole 18, the drainage property in a windless state can be improved. In this case, when the drainage holes 18 are formed at both side end portions, the bottom at the inner portion of the hand insertion unit 5 may have a convex structure 46 which is gently inclined as shown in FIG. 11.

The configuration of the components of the hand dryer of the embodiment will be described in sequence.

Description of the Heat Radiation Structure for the Circuit Unit

Figure 13:
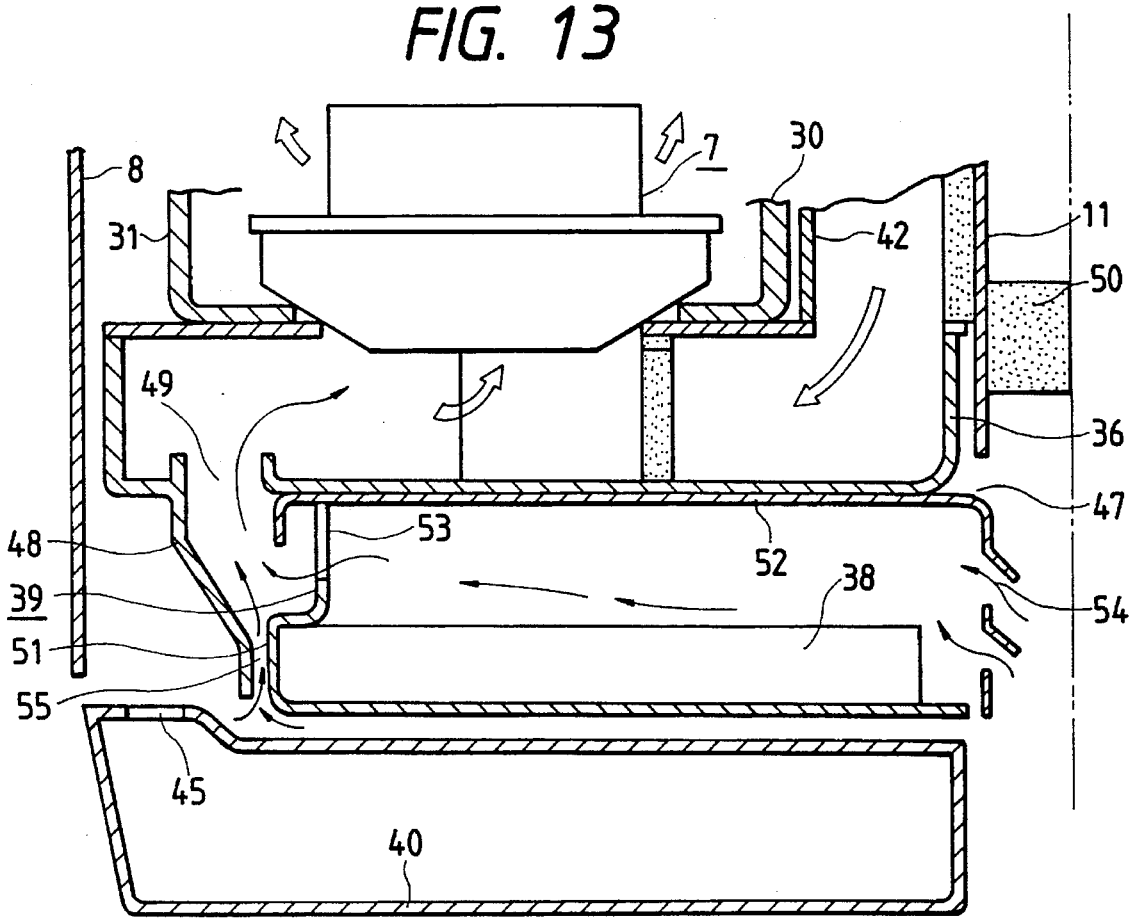
FIG. 13 is a longitudinal cross section view showing on an enlarged scale the configuration of the lower portion of the case of the hand dryer according to the embodiment of the invention.

As shown in FIG. 13 in an enlarged manner, the space between the legs 35 of the frame 14 wherein the circuit box 39 is housed is configured so as to function as the air duct which elongates forward and backward. More specifically, at the corresponding position of the rear plate 11, formed is an opening 47 through which the rear of the circuit box 39 is exposed, and, before the front face of the circuit box 39, located is a guide wall 48 which is formed on the lower face of the bottom of the first air guide 36. The guide wall 48 is formed so that the gap between the guide wall and the lower portion of the circuit box 39 is narrower. A vent hole 49 is formed at the base of the side wall and in the bottom of the first air guide 36. When the high-pressure air flow generation device 7 operates, therefore, the air is sucked in through the vent hole 49 to form air flows at this portion. At a position of the rear plate 11 which approximately corresponds to the flat portion 29 of the frame 14, disposed is a thermal barrier 50 which extends in the full width and protrudes to the rear side.

Figure 14:
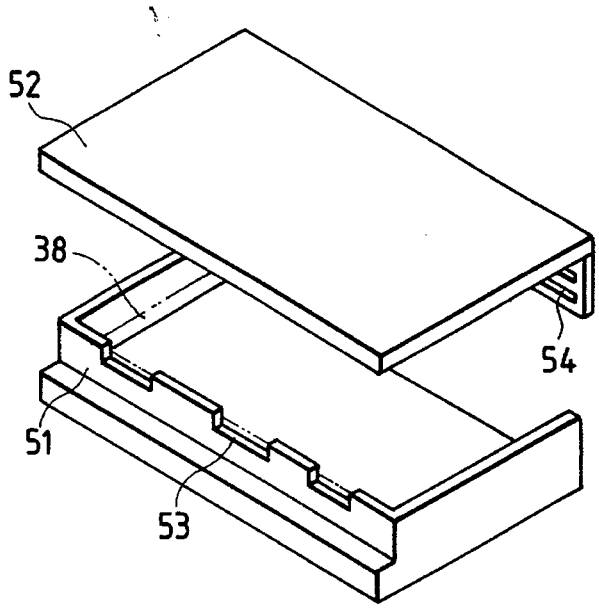
FIG. 14 is a perspective view showing the configuration of a circuit box of the hand dryer according to the embodiment of the invention.

As shown in FIG. 14, the circuit box 39 has a rectangular open vessel-like body 51 which is configured so as to function as a heat radiating plate, and a lid 52 for waterproofing is placed on the body. The circuit unit 38 is accommodated on the bottom of the body 51. At the upper edge of the front face of the body 51, ventilating windows 53 are formed by recess-like indents, and a gallery-like air intake 54 is opened on the back face of the lid 52. In order to ensure the waterproof, the lid 52 is configured so as to overhang the body 51.

The thermal barrier 50 divides or blocks the vertical air flow in the rear of the case 6, and is formed by adhering polyurethane foam which can easily be contacted to a wall of an installation position in a mounting state. It is a matter of course that the thermal barrier 50 may be modified so as to have a rib-like projection structure, without producing any functional problem.

In the heat radiation structure for the circuit unit 38, since the circuit box 39 which is ventilable is mounted in the air duct, the heat radiation of the circuit unit 38 is very smoothly conducted. More specifically, when the high-pressure air flow generation device 7 operates, the air is sucked in through the vent hole 49 to form air flows as indicated by arrows in FIG. 13. One of the air flows enters the circuit box 39 from the air intake 54 of the circuit box 39 which is at the rear of the case 6 and faces to the exterior, moves across the circuit box 39, and is sucked into the first air guide 36 from the ventilating windows 53 along the guide wall 48. Another air flow enters from an air intake which is smaller than that for the above-mentioned one air flow, and therefore is a weaker one. Namely, the other air flow is formed by causing the air in the side of the drain tank 40 to be sucked from a narrow path 55 between the guide wall 48 and the lower front portion of the circuit box 39 into the first air guide 36, through the space between the guide wall 48 and the front portion of the circuit box 39. The other air flow is effective because it transfers the heat of the surface in the vicinity of the bottom of the body 51 which functions also as the heat radiating plate for the circuit box 39. Therefore, the cooling of the circuit box 39 is conducted very satisfactorily by the two air flows one of which penetrates the inside of the box and the other of which moves along the surface of the box.

The temperature of the air in the rear side of the case 6, particularly that above the high-pressure air flow generation device 7 is raised owing to the operation of the device. All the air flows for cooling are originated in the air which is separated from the hot air in the upper side by the thermal barrier 50 disposed on the rear plate 11 and which is excellent in cooling property, whereby the cooling efficiency of the circuit box 39 is increased. A configuration in which an air duct for cooling is not separately formed and the cooling of the circuit box 39 is effected by placing the circuit box 39 in the path for circulating the air for drying hands is not appropriate because the water content of the air flow for drying hands is high.

Description of the Drain Tank

The drain tank 40 is mounted on tank supporters 56 formed on the legs 35 of the frame 14, and pressed by the resilience of a plate spring 57 attached to the lower face of the circuit box 39 so that it is stably forward inclined. The drain tank 40 can be pulled out or mounted using a hand hold 58 formed on the lower face of the tank. The inner ends of the tank supporters 56 are separated from the rear plate 11 so that the tank supporters 56 do not constitute a water path toward the rear plate 11. The forward inclination of the drain tank 40 allows that, even when the state where the tank is filled with water is not noticed and water overflows from the faucet 45 in the upper face, floodwater flows toward the front, thereby preventing the wall of the mounting place in the rear side from being wetted. In order to prevent such a case where the tank is filled with water and water overflows from the upper face, from occurring, a drain hole 59 for suppressing an overflow may be formed at an appropriate position on the side or the like of the drain tank 40 as shown in FIG. 9, so that the water level of the tank is kept lower than the drain hole 59. Alternatively, the faucet 45 may be formed in a recess which is lower than the upper face of the tank.

In the drain tank 40 wherein an overflow from the upper face is prevented by the drain hole 59, the position and direction of the drainage can be restricted in a certain degree, and therefore the wall of the mounting place in the rear side can be prevented from being wetted even when the tank is mounted in a posture other than the forward inclined posture. Furthermore, the drain hole 59 is convenient to completely remove water from the tank. More specifically, in order to facilitate the water intake and prevent water from splashing out from the tank even when shaken, the periphery of the faucet 45 of the drain tank 40 enters the tank to form a funnel-like shape. When water is to be drained through the faucet 45, therefore, the funnel-like periphery obstructs the drainage, resulting in that a small amount of water always remains in the tank. When water is drained through the drain hole 59 having the smooth inner face, the remaining water can easily be drained out. If the drain hole 59 is provided only for completely draining remaining water, it may be formed in any of the upper, back, rear and front faces of the drain tank 40.

Description of the Blowout Nozzles

Both the upper and lower blowout nozzles 32 and 33 are mounted to the hand insertion unit 5. Considering that the nozzles must be inclined to produce a pressure gradient directed from the inlet toward the inner portion, that they are subjected to a high pressure, and that they are required to have improved assembling properties, they are respectively structured as a single body which is to be fitted into a mounting hole formed in the upper and lower insertion unit panels 9 constituting the hand insertion unit 5, and provided with a face 60 having the nozzle holes 34 and continuous with the profile of the inner face of the respective insertion unit panels 9 (see FIG. 10). All components including the peripheries of the nozzle holes 34 may be formed on the face 60 continuous with the profile of the inner face of the insertion unit panel 9. Alternatively, only the peripheries of the nozzle holes 34 may be protruded slightly in a nipplelike manner. In other words, the upper and lower blowout nozzles 32 and 33 are constructed in a completed manner so that all requirements on the nozzles such as the angle of the nozzle hole 34 can be filled by fitting the nozzles to the respective mounting holes.

According to above-described configuration, all requirements on the upper and lower blowout nozzles 32 and 33 are satisfied only by fitting them into the mounting holes formed in the upper and lower insertion unit panels 9. Under the mounted state, since the nozzles have a shape which assimilates with the profile of the inner face of the hand insertion unit 5, the touch and appearance are improved, and it is hardly soiled.

Figure 3:
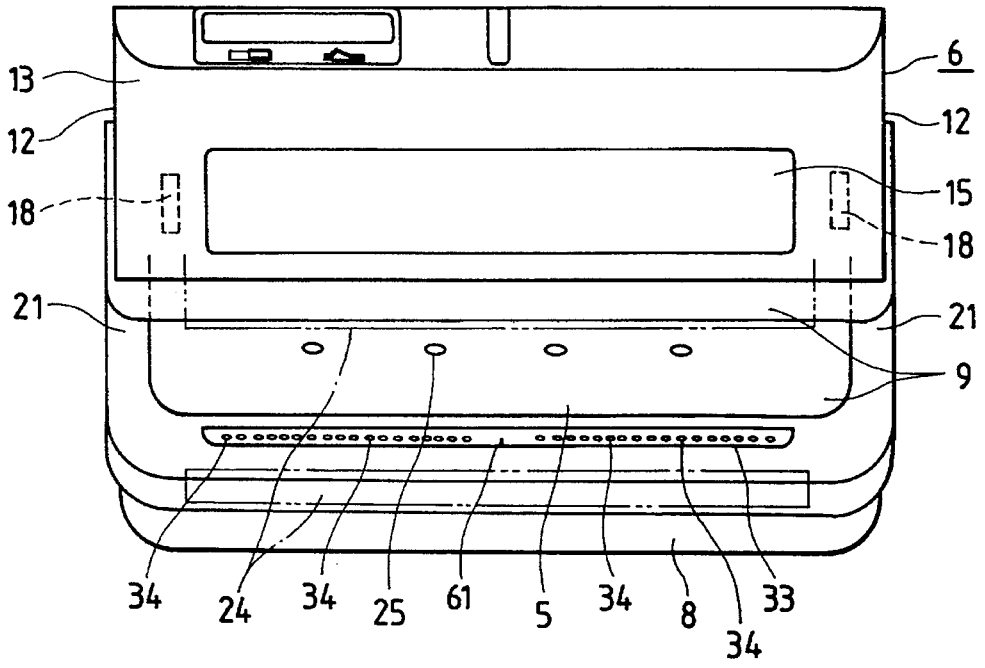
FIG. 3 is a plan view showing the whole of the hand dryer according to the embodiment of the invention.

In both the upper and lower blowout nozzles 32 and 33, a plurality of the nozzle holes 34 are arranged on the face 60 continuous with the profile of the inner face of the insertion unit panel 9. At least at the center portion of the lower blowout nozzle 33, the nozzle holes 34 are arranged so that a gap 61 corresponding to distance between hands obtained when the user naturally puts both hands is formed or that the pitch is greater than that at another portion (see FIG. 3).

This causes a region where the wind is weak, to be produced in the center of the hand insertion unit 5. Therefore, the wind having a higher water content is prevented from blowing through the gap between the hands toward the face of the user, and an excellent wind environment which advantageously affects the above-mentioned drainage from the drainage holes 18 can be established in the hand insertion unit 5.

Description of the Structure of Mounting the Blowout Nozzles

Figure 10:
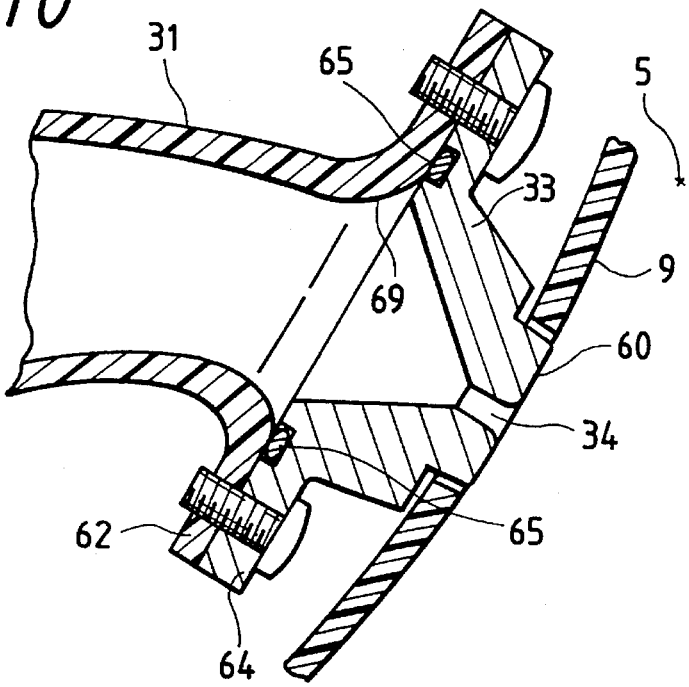
FIG. 10 is a section view showing on an enlarged scale a portion of mounting a lower blowout nozzle of the hand dryer according to the embodiment of the invention.
Figure 15:
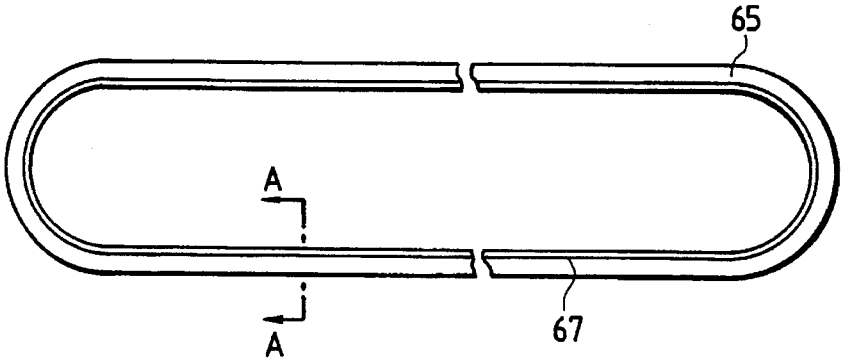
FIG. 15 is an enlarged plan view of an O-ring of the hand dryer according to the embodiment of the invention.

As shown in FIG. 8, the upper and lower blowout nozzles 32 and 33 are respectively connected and fixed to the blowout ends of the upper and lower air ducts 30 and 31 which ends are flattened and extended into a flattened trumpet-like shape. A flange 62 outwardly extending is integrally formed at the blowout end of each of the upper and lower air ducts 30 and 31. On the other hand, each of the upper and lower blowout nozzles 32 and 33 is provided with a flange 64 which extends radially with respect to a high-pressure air flow introduction unit 63. The nozzles 32, 33 and the air duct 30, 31 are connected to each other by sandwiching an O-ring 65 as shown in FIG. 15 and functioning as an air tight member between the flange 62 of the duct and the flange 64 of the nozzle, backing the rear face of the flange 62 of the duct with a mounting plate 66, and fastening the flanges 62 and 64 to each other with a plurality of screws (FIGS. 10 and 17).

While being respectively attached to the upper and lower air ducts 30 and 31, the upper and lower blowout nozzles 32 and 33 are attached to the back side of the hand insertion unit 5 by attaching screws. The attaching screws are screwed at the left, right and upper portions in bosses formed in the periphery of the mounting holes, so as to fasten both the flanges 62 and 64 to each other. Since the lower portions of the upper and lower blowout nozzles 32 and 33 are behind the upper and lower air ducts 30 and 31, it is difficult to conduct the thread fastening operation. At the lower portions, therefore, the flanges are fastened to each other by an engaging structure (not shown) which comprises an engaging projection for restricting the forward and backward movement, and an engaging portion (not shown) engaging with the projection. The engaging projection and the engaging portion are formed on the flanges of the nozzle and the duct, respectively. Such a structure allows the upper and lower blowout nozzles 32 and 33 to be mounted by a simple mounting work so as to be stable even when subjected to a high-pressure air.

Figure 16:
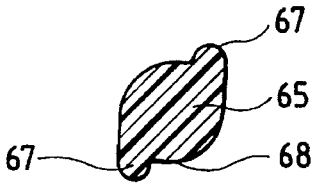
FIG. 16 is an enlarged cross section view along line A- A of FIG. 15.

Description of the Holding of the Airtightness of the Nozzle Mounting Portion The O-ring 65 which is sandwiched between the nozzle and the duct in order to ensure the airtightness has in a free state a section shape similar to two united commas as shown in FIG. 16. Namely, in the O-ring 65, a projection-, rib- or lip-like high-airtight holding structure 67 which elongates and has a weak compression strength is integrally formed at an end of each of the opposing faces to which a compression load is to be applied. In the illustrated example, two high-airtight holding structures 67 are arranged in a zigzag manner with respect to the opposing faces. Alternatively, only the face 68 which is to be pressed against the flange 62 of the duct may be provided with the high-airtight holding structures 67, without producing any functional problem.

Figure 17:
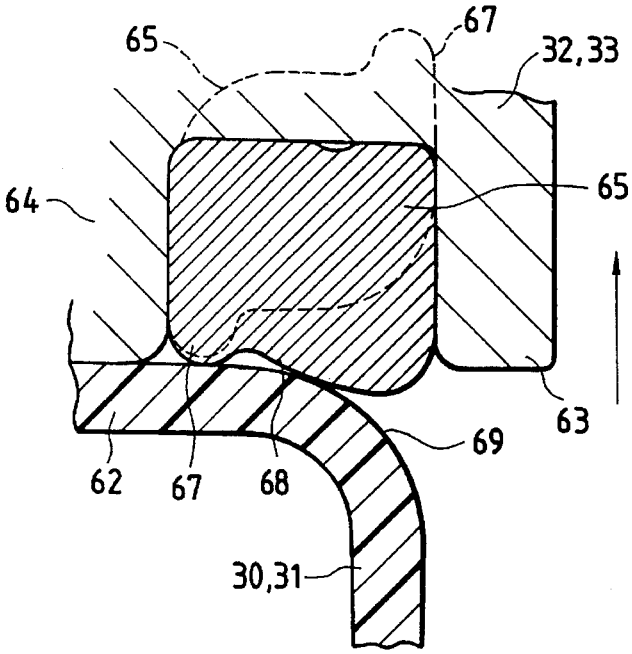
FIG. 17 is an enlarged cross section view showing the function of the O-ring of the hand dryer according to the embodiment of the invention.

When the O-ring 65 is sandwiched between the flange 62 of the duct and the flange 64 of the nozzle and compressed by turning the screws, the O-ring deforms from the free-state shape indicated by a broken line in FIG. 17 to the functional-state shape indicated by a solid line in the figure. More specifically, when the high-airtight holding structures 67 of the both sides are collapsed by compression, the collapsed volume escapes to enter the space between a rounded portion continuous with the flange 62 of the duct and the cylindrical high-pressure air introduction unit 63 in the nozzle side, thereby closing the portion in a high-airtight state. Accordingly, the airtightness for the high-pressure air sent from the high-pressure air flow generation device 7 can be maintained surely and firmly for a long period.

Description of the Configuration of the Air Inlet of the Hand Insertion Unit

As described above, the mesh filter 20 is detachably attached to the air inlet 19, so that foreign materials such as a paper sheet, a handkerchief, and the like are prevented from being erroneously sucked in the air inlet. The embodiment is provided with another configuration for preventing foreign materials from entering the inside, as shown in FIG. 5, or with a grating 70 (longitudinal, transverse or lattice-like) which is located inside the mesh filter 20 and which does not disturb the ventilation. In the embodiment, the grating 70 is formed integrally on the opening of the second air guide 42 which is to be connected to the air inlet 19. The grating 70 may be formed as a separate part and attached to the opening, or may be formed integrally or separately on the air inlet 19 of the hand insertion unit 5.

Even when an article is erroneously dropped into the hand insertion unit 5 under the state where the filter 20 is removed for the purpose of cleaning, etc., the article is inhibited by the grating 70 from entering inside the air inlet 19, whereby a trouble due to the ingress of a foreign material can be prevented as much as possible from occurring.

Description of the Configuration for Sound Insulation

In the hand dryer of the embodiment, measures for sound insulation are adopted. For example, the DC brushless motors 27 of the high-pressure air flow generation device 7 are covered by a sound absorbing material, and the inner face of the front panel 8 is lined with a sound absorbing material. Hereinafter, the configuration for insulating the sound generated when the air is sucked from the first air guide 36 into the high-pressure air flow generation device 7 will be described. As shown in FIG. 9, semicylindrical or horseshoe-shaped sound barriers 72 having an arcuate face 71 are disposed on the bottom of the first air guide 36 in such a manner the arcuate faces 71 are directed to the inlet of the air flow from the second air guide 42. The upper end faces of the sound barriers 72 are butted against the bore periphery of the inlet portion of the high-pressure air flow generation device 7. The air itself is sucked through open regions 73 of the sound barriers 72. In the embodiment, the two sound barriers 72 made of a sound absorbing material are fixedly adhered to the bottom of the first air guide 36. Alternatively, sound barriers may be formed as portions integral with the bottom of the first air guide 36.

The shape of the thus configured sound barriers 72 straightens the air suction flow from the first air guide 36 to the high-pressure air flow generation device 7, thereby reducing the level of the sound generated when the air is sucked. Moreover, the sound barriers block the sound generated when the air is sucked. Therefore, the level of the sound leaking from the air inlet 19 of the hand insertion unit 5 is reduced so that the silence during the operation is enhanced.

Description of the Wall Mounting Structure

The hand dryer of the embodiment is installed by fixing the rear face to an inner wall of a lavatory or the like. The mounting on the wall is conducted using the wall mounting plate 10 shown in FIG. 6. The wall mounting plate 10 is a plate which has a width substantially equal to that of the rear plate 11 of the case 6 and a longitudinal size slightly shorter than that of the rear plate 11, and is fixed to a wall by several screws. At the upper left and right portions of the wall mounting plate 10, upward hanging hooks 74 are raised by punching in the direction opposite to the wall abutting face. Threaded fixing portions 75 are formed at lower and upper center portions, respectively. Stabilizing periphery portions 76 protruding in a substantially same distance as the hanging hooks 74 are continuously or discontinuously formed at the both side peripheries of the wall mounting plate 10. The rear plate 11 of the case 6 is provided with mounting holes 77 which engage with the hanging hooks 74, and threaded fixing portions 78 which are located at the upper and lower center portions and correspond to the threaded fixing portions 75.

The case 6 is hooked on the wall mounting plate 10, and fixed thereto by screws. In this case, the stabilizing periphery portions 76 at the both sides of the wall mounting plate 10 butt against the rear plate 11 of the case 6, thereby restricting the leftward and rightward shaking of the case 6 so that the case 6 is stably mounted. The stabilizing periphery portions 76 function also as ribs for increasing the stiffness of the wall mounting plate 10 itself. When the case 6 is slightly forward inclined, it is effective in preventing a leakage of water toward the rear side which has been described in conjunction with the drain tank 40, from occurring.

Control of the High-Pressure Air Flow Generation Device, Using Sensors

Figure 21:
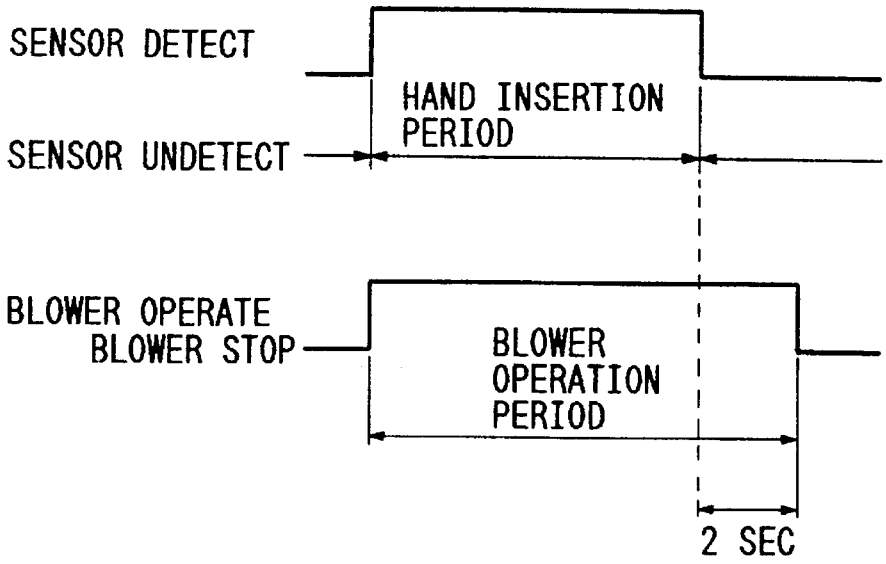
FIG. 21 is a timing chart showing an operation state of the high-pressure air flow generation device of the hand dryer according to the embodiment of the invention.

Next, the sensors 25 will be specifically described with reference to FIG. 21. FIG. 21 is a timing chart showing an operation state of the high-pressure air flow generation device of the hand dryer according to the embodiment of the invention.

As shown in FIG. 21, when the inlet upper and lower sensors 25 which are respectively disposed on the upper and lower faces in the vicinity of the inlet of the hand insertion unit 5 detect hands, the high-pressure air flow generation device 7 comprising blowers starts to operate. Then, the hands are removed from the hand insertion unit 5, and the inlet upper and lower sensors 25 enter the non-detection state. During 2 seconds after this, the high-pressure air generation device 7 comprising blowers continues to operate. In other words, there is a time lag of 2 seconds between the removal of hands and the stop of the operation of the high-pressure air flow generation device 7.

In this way, the high-pressure air flow generation device 7 continues to operate for 2 seconds after the removal of hands, and therefore the high-speed air can be surely blown out from the blowout nozzles 32 and 33 during a period from the insertion of hands to the removal of the hands. As a result, the drying can be conducted without delay and the smooth drying operation can be maintained. In addition to the inlet upper and lower sensors 25, the hand detection of the inner upper and lower sensors 25 may be used to control the operation of the high-pressure air flow generation device 7.

Figure 22:
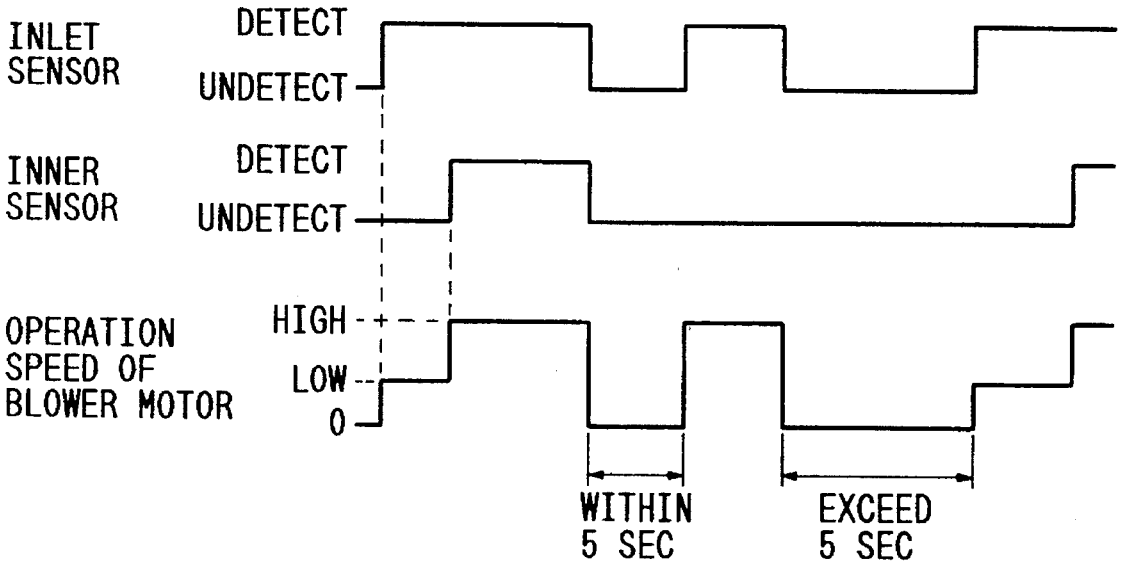
FIG. 22 is a timing chart showing an operation state of a high-pressure air flow generation device of a hand dryer according to another embodiment of the invention.

FIG. 22 is a timing chart showing an operation state of the high-pressure air flow generation device 7 of a hand dryer according to another embodiment of the invention. The other basic structure of the embodiment is identical with that of the above-described embodiment.

Also in the embodiment, in the same manner as the above-described embodiment, the hand insertion unit 5 is provided with the inlet upper and lower sensors 25, and the inner upper and lower sensors 25. In a stage where the inlet upper and lower sensors 25 detect hands, the high- pressure air generation device 7 operates at a low speed, and, in a stage where the inner upper and lower sensors 25 detect hands, the high-pressure air flow generation device 7 operates at a high speed, thereby increasing the drying ability.

According to the embodiment, as shown in FIG. 22, in the case where hands are inserted to be again subjected to the drying process into the hand insertion unit 5 within 5 seconds after hands have been removed from the hand insertion unit 5 and the inlet upper and lower sensors 25 have entered the non-detection state to stop the operation of the high-pressure air flow generation device 7, the high-pressure air generation device 7 immediately starts to operate at a high speed. Namely, in this case, merely a detection of hands by the inlet upper and lower sensors 25 causes the high-pressure air flow generation device 7 to operate at a high speed. By contrast, in the case where the period of 5 seconds elapses after hands have been removed from the hand insertion unit 5 and the inlet upper and lower sensors 25 have entered the non-detection state to stop the operation of the high-pressure air flow generation device 7, the detection of hands by the inlet upper and lower sensors 25 causes the high-pressure air flow generation device 7 to start to operate at a low speed, and, in a stage where the inner upper and lower sensors 25 detect hands, the high-pressure air flow generation device 7 operates at a high speed, in the same manner as the above-described embodiment.

In this way, according to the hand dryer of the embodiment, the operation of the high-pressure air flow generation device 7 which supplies a high-pressure air flow to the blowout nozzles 32 and 33 disposed in the hand insertion unit 5 is controlled in the following manner using the inlet upper and lower sensors 25 disposed in the inlet of the hand insertion unit 5 and the inner upper and lower sensors 25 disposed at the inner portion which detect hands inserted in the hand insertion unit 5. Even in the case where the inner upper and lower sensors 25 enter from the detection state into the non-detection state, when the inlet upper and lower sensors 25 are in the detection state, the high-pressure air generation device 7 operates at a high speed. In the period of 5 seconds (the predetermined period) after the stop of the operation, the device is caused to operate at a high speed only by the detection state of the inlet upper and lower sensors 25. When the period of 5 seconds has elapsed after the stop of the operation, the device starts to operate at a low speed in response to the detection by the inlet upper and lower sensors 25. The operation of the high-pressure air flow generation device 7 is controlled by the control circuit 28. Instead of the above mentioned low-speed operation, the device can be placed in a stopped condition.

When hands are inserted into and removed from the hand insertion unit 5 in a relatively frequent manner or when the hand is withdrawn from the hand insertion unit 5 and fingers are inserted again to dry up, therefore, a high-speed air is caused to be blown out from the blowout nozzles 32 and 33 only by the insertion of hands into the inlet of the hand insertion unit 5. Accordingly, the high-pressure air flow generation device 7 can efficiently be operated so that the period of drying hands is shortened. As a result, an efficient drying can be realized.

Description of the Sensitivity Adjustment of the Sensors

Figure 23:
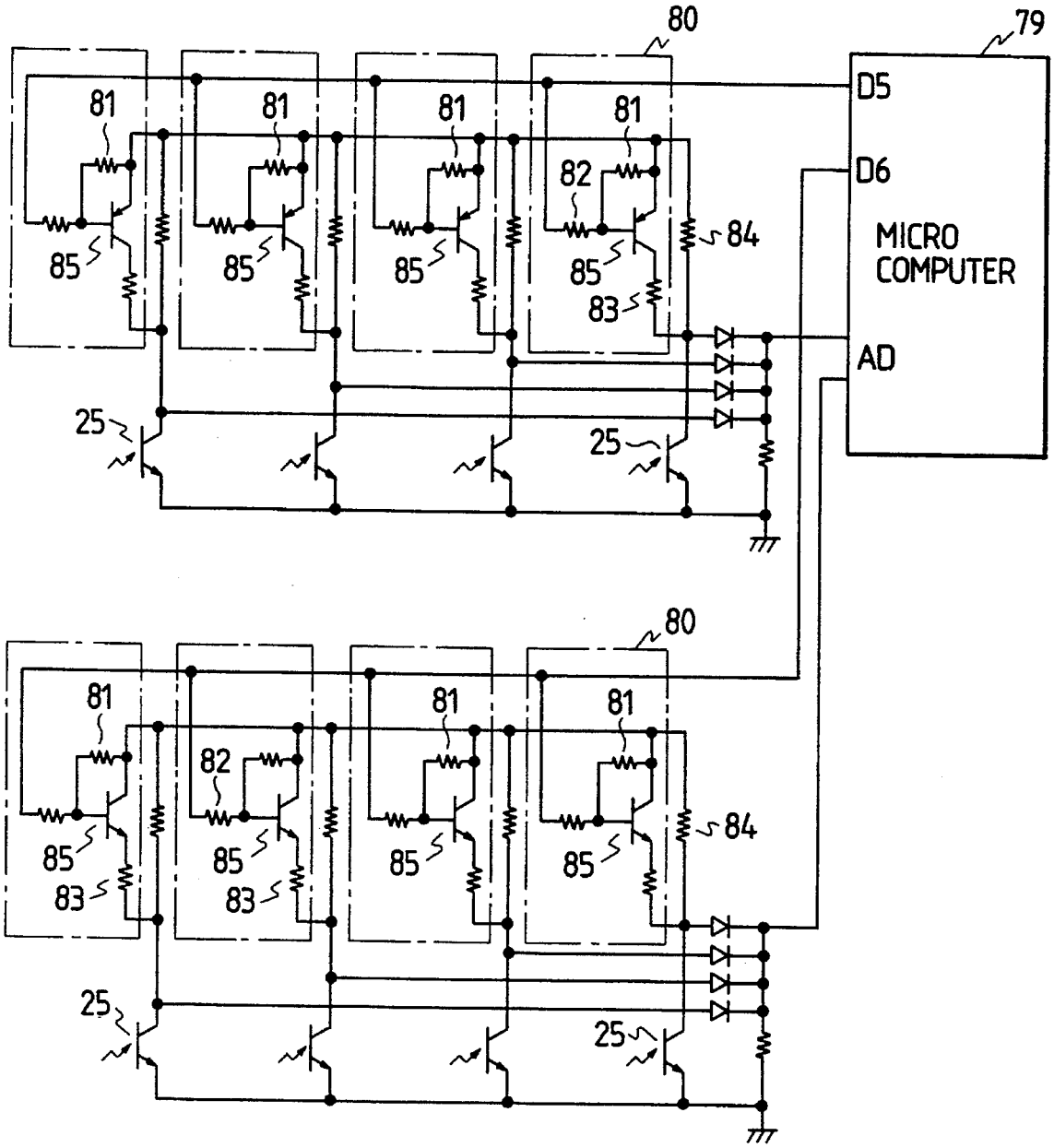
FIG. 23 is a circuit diagram of an automatic sensor sensitivity correction device of the hand dryer according to the embodiment of the invention.

The inlet and inner sensors 25 which detect using infrared light beams the insertion and removal of hands in the hand insertion unit 5 may fail to maintain their desired detection accuracy in accordance with difference in the optical environment of the installation place or variation in light emitting strength due to the elapse of time of the sensors. Therefore, the hand dryer of the embodiment is provided with an automatic sensor sensitivity correcting device shown in FIG. 23. The automatic sensor sensitivity correcting device consists of a microcomputer 79 and correcting circuits 80. Each of the correcting circuits 80 is connected to the plurality of infrared light receiving elements such as phototransistors, and consists of resistors 81 to 84 and transistors 85. The bases of the transistor 85 of the correcting circuits 80 are connected to output ports D5 and D6 of the microcomputer 79, respectively. The On/Off operation of the transistors is controlled by switching the High/Low level of the output ports D5 and D6. The outputs of the infrared light receiving elements such as phototransistors of the sensors 25 are A/D-converted and then input to the microcomputer 79.

Figure 24:
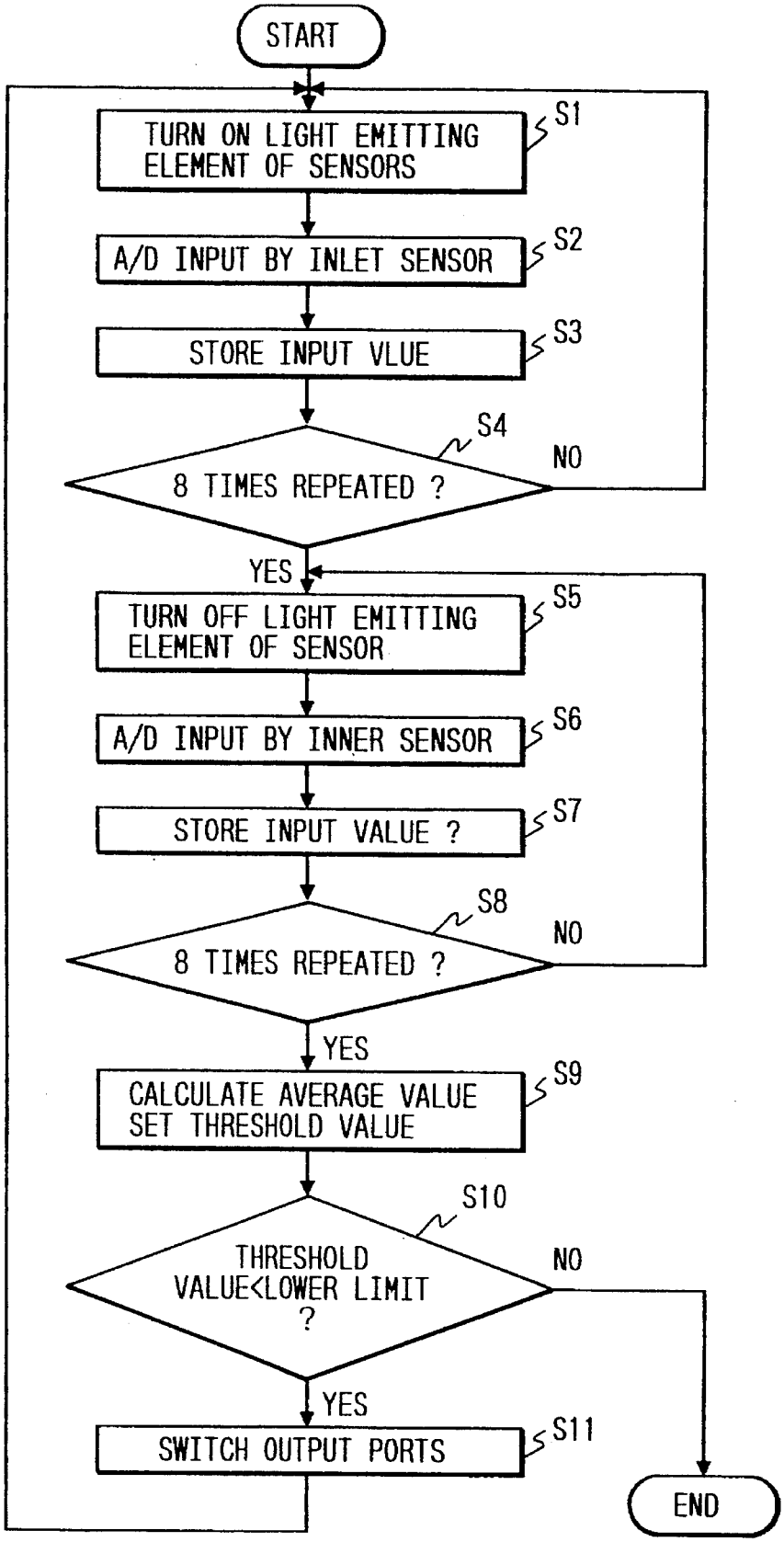
FIG. 24 is a flowchart showing the operation of the automatic sensor sensitivity correction device of the hand dryer according to the embodiment of the invention.

The correction of the sensor sensitivity is accomplished by a program stored in the microcomputer 79. FIG. 24 is a flowchart showing the program. When the power is on or at a fixed period, the infrared light emitting elements such as light emitting diodes of the sensors 25 are first lit in step 1. The A/D-converted outputs of the infrared light receiving elements of the sensors 25 at this time are input in step 2, and the A/D-converted inputs are stored in a memory in step 3. In the embodiment, in order to prevent errors due to noises from being produced, the detection of the output levels of the sensors 25 is repeated, for example, eight times, and the output levels of all detections are stored in the memory. In step 4, it is judged whether or not the predetermined number of detections have been conducted. If not, the process returns to step 1, and, if yes, the process advances to step 5.

In steps 5 to 8, operations similar to steps 1 to 4 are conducted with respect to the sensors 25 of the other stage (for example, those disposed at the inner portion). In this case, however, these operations are conducted while the infrared light emitting elements of the sensors 25 are unlit. In other words, the brightness relationship between the lighting and unlighting states of the light emitting elements is set. After the output levels of the inlet and inner sensors 25 have been detected, the process advances to step 9. In step 9, an average of the eight output levels is calculated, and the threshold is set. In order to avoid a malfunction continuing for, e.g., 30 seconds under a sensitivity abnormal state, upper and lower limits are provided for the threshold. When the level exceeds the upper limit, the threshold is treated as the upper limit, and, when the level is less than the lower limit, the threshold is treated as the lower limit. In step 10, the threshold in step 9 is checked to judge whether or not it is greater than the lower limit. If the threshold is greater than the lower limit in step 10, the correction program is ended. If the threshold is smaller than the lower limit, the process advances to step 11. In step 11, the levels of the output ports D5 and D6 (the inlet sensors and the inner sensors are set individually and independently) of the microcomputer 79 are changed from the High level to the Low level. Thereafter, the process returns to step 1.

As a result of the above procedure, the transistors 85 are turned on, and the currents supplied to the respective infrared light receiving elements are raised in level and the input sensitivity is lowered. More specifically, the sensitivity adjustment of the sensors 25 which conforms to the situation is automatically conducted at the power-on or at a fixed period, thereby avoiding a malfunction due to a trouble in the sensors 25.

Furthermore, even when the brightness of a lavatory or the like in which the hand dryer is installed is changed and the sensors 25 are considerably affected, the sensors 25 become hard to malfunction. Even when the light intensity of a light emitting element is reduced owing to aging, the correction of the threshold enables the element to conduct the normal sensing operation under the condition of a reduced light intensity.

Figure 29:
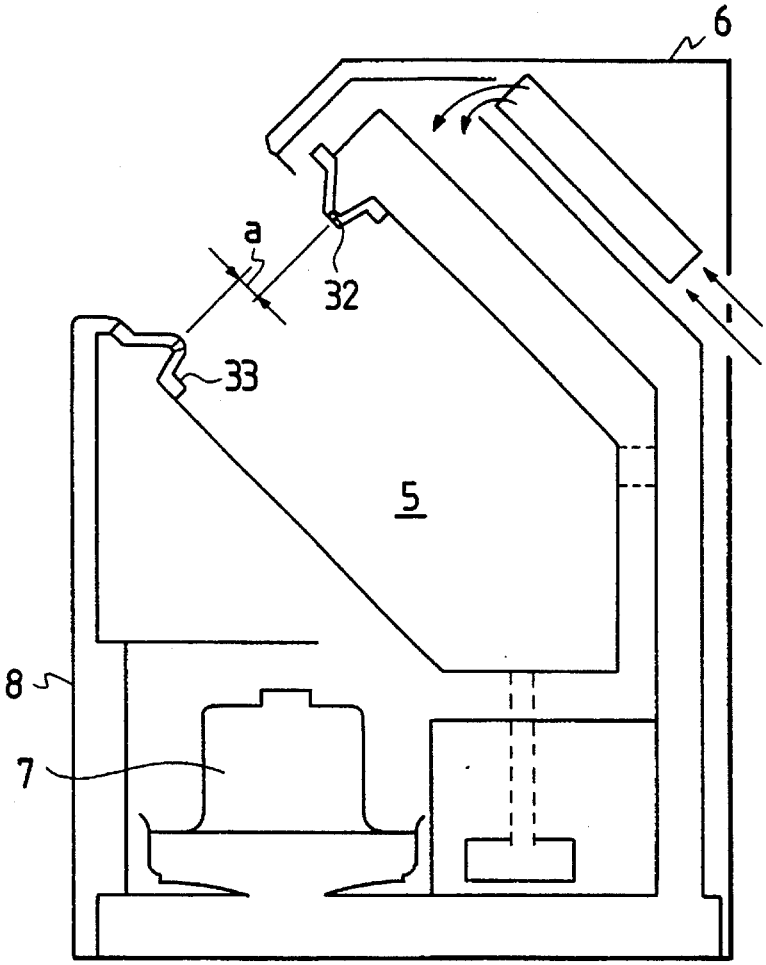
FIG. 29 is a diagrammatic view of a hand dryer according to another embodiment of the invention, and particularly showing deviation of nozzles.
Figure 30:
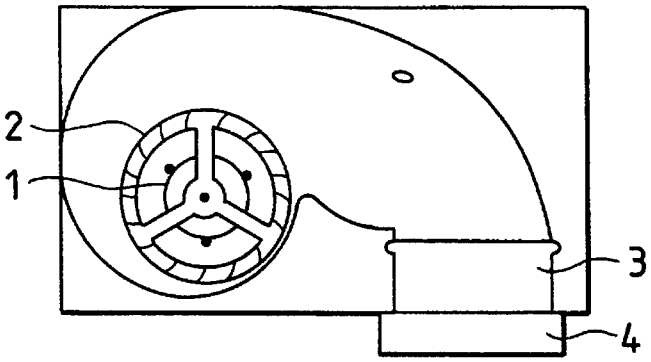
FIG. 30 PRIOR ART
FIG. 30 is a front view of a prior art hand dryer.

FIG. 29 is a section view showing another embodiment. In the embodiment, the upper and lower blowout nozzles 32 and 33 are shifted from each other by a distance a.

When a high-pressure air flow is blown out from the nozzles 32 and 33 under this state, the produced air flows from the nozzles do not directly collide with each other. Therefore, the level of a noise due to the collision of air flows can be reduced. Moreover, in the hand insertion unit 5, the pressure loss can be prevented from being generated, and the occurrence of turbulent flow can be suppressed.

Description of the Insulation for Preventing an Electric Leakage

In the hand dryer of the embodiment, as described above, the high-pressure air flow generation device 7 is located in a flow path of the air having a higher water content. The DC brushless motors 27 of the high-pressure air flow generation device 7 which are driven by the driving circuit 28 in accordance with the invertor control may suck water contained in the air flow. In the DC brushless motors 27, incorporated is a pole position detecting circuit 87 which detects using Hall elements 86 the positions of the poles to determine the phase for supplying a current to the motor windings. The detection portions of the Hall elements 86 are structurally exposed. When water contained in the air flow enters into the DC brushless motors 27, therefore, the electrical insulation between the pole position detecting circuit 87 and the stator core, and between the stator core and the motor frame may not be sustained, thereby causing an electric leakage.

Figure 25:
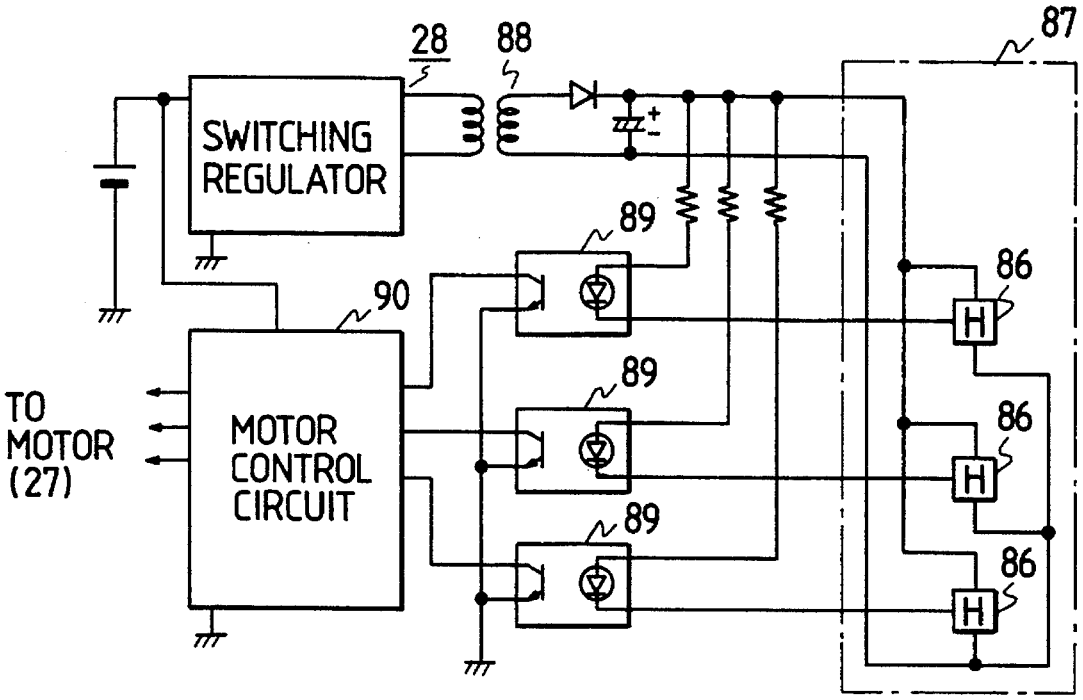
FIG. 25 is a circuit diagram of a driving circuit for controlling the high-pressure air flow generation device of the hand dryer according to the embodiment of the invention.

To comply with this, in the hand dryer of the embodiment, the driving circuit 28 is configured as shown in FIG. 25. The power is supplied to the Hall elements 86 through an insulating transformer 88. The output of the pole position detecting circuit 87 is supplied to a motor control circuit 90 through photocouplers 89. The portion in the side of the pole position detecting circuit 87 is insulated from that in the side of the power supply and the motor control circuit 90. Even when water enters into the DC brushless motors 27, this configuration can prevent an electric leakage in the Hall elements 86 from occurring, thereby stabilizing the function and improving the safety.

Description of the Display Unit

Figure 26:
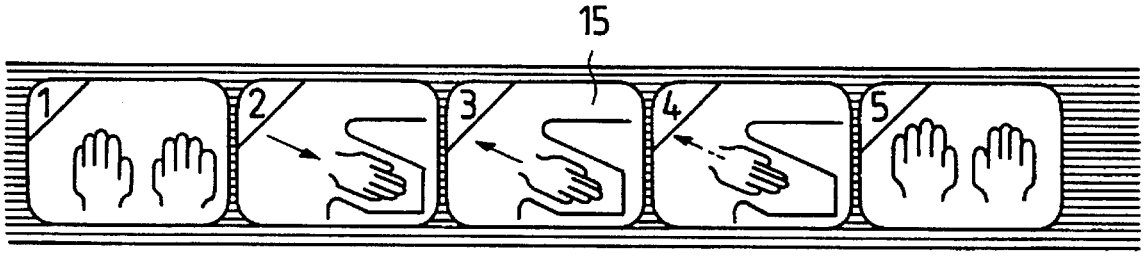
FIG. 26 is a front view of a display unit of the hand dryer according to the embodiment of the invention.
Figure 27:
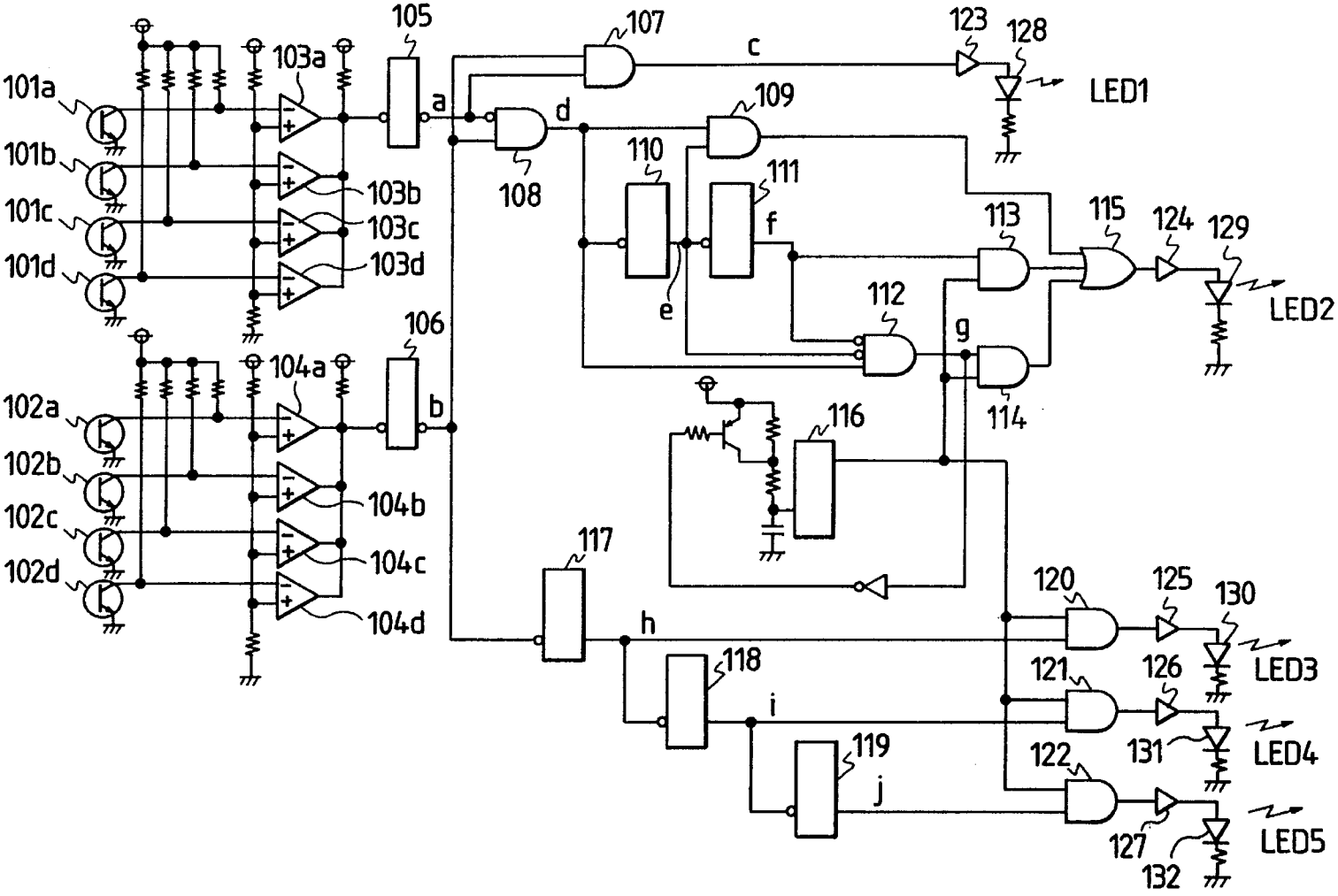
FIG. 27 is a circuit diagram of a control circuit for controlling the display unit of the hand dryer according to the embodiment of the invention.
Figure 28:
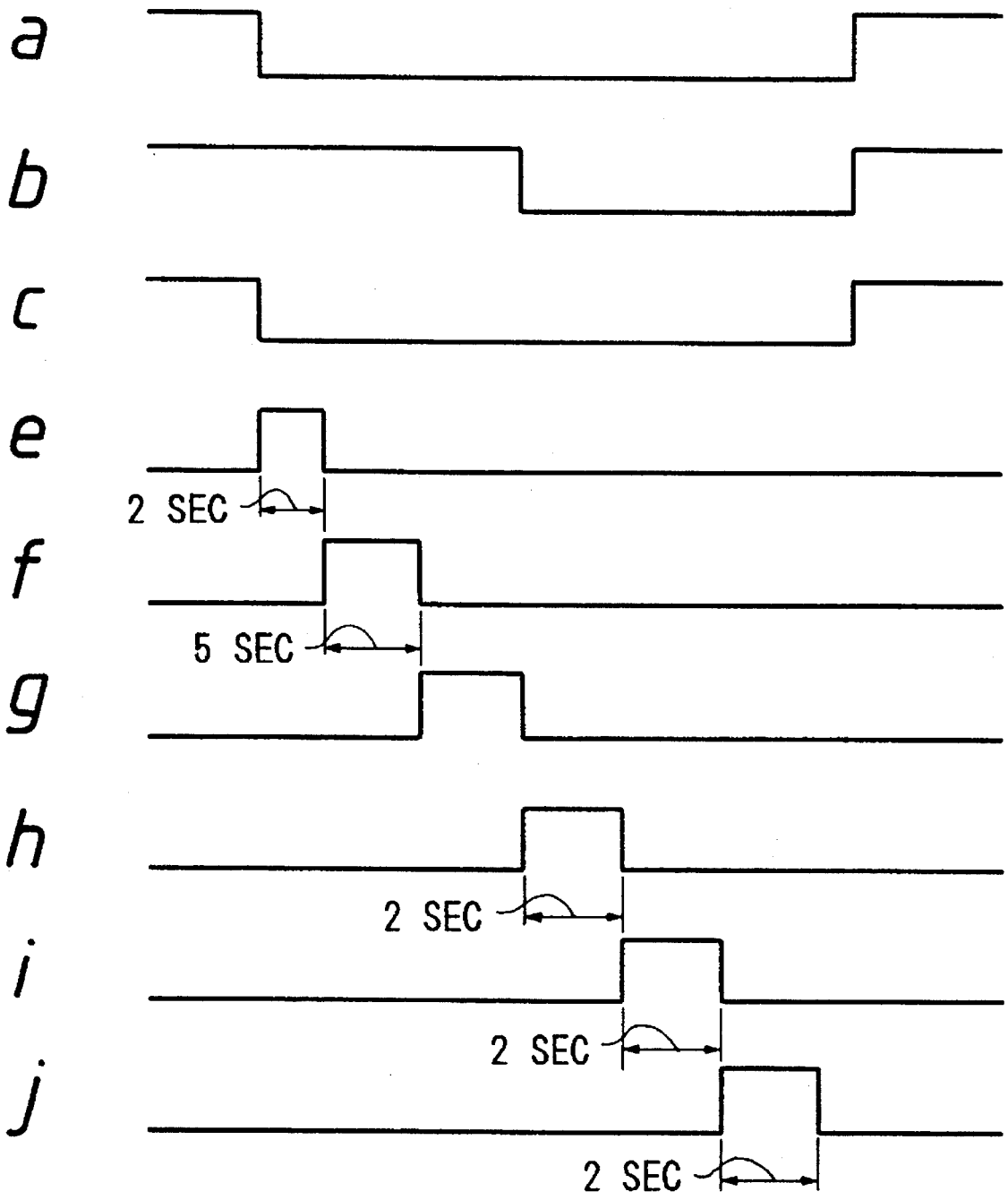
FIG. 28 is a timing chart showing the operation of the control circuit of FIG. 27.

In FIG. 27, 101*a* to 101*d* are the infrared phototransistors (inlet upper sensors 25) which are arranged at positions opposing the infrared light emitting diodes (inlet lower sensors 25) arranged in the inlet of the hand insertion unit 5, and 102*a* to 102*d* are the infrared phototransistors (inner upper sensors 25) which are arranged at positions opposing the infrared light emitting diodes (inner lower sensors 25) arranged at the inner portion of the hand insertion unit 5. The numbers of the phototransistors 101*a* to 101*d* and 102*a* to 102*d* are four, respectively. The reference numerals 103*a* to 103*d* and 104*a* to 104*d* are comparators to which the collectors of the phototransistors 101*a* to 101*d* and 102*a* to 102*d* are respectively connected and which compare the levels of the collectors with the threshold determined by resistance-potential division. The reference numerals 105 and 106 are latch circuits for latching the outputs of the comparators 103*a* to 103*d* and 104*a* to 104*d*, and 107, 109, 112 to 114, and 120 to 122 are AND circuits which are logic circuits, and 115 is an OR circuit. The reference numerals 110, 111, and 117 to 119 are timer circuits, and 116 is an oscillation circuit which oscillates at a predetermined frequency. The reference numerals 123 to 127 are light emitting diode driving elements, and 128 to 132 are light emitting diodes which are light emitting elements for display. By the light emitting diodes 128 to 132, the display unit 15 of a display panel shown in FIG. 26 is adequately illuminated for display.

In the thus configured display unit control circuit, when the power is on, the infrared phototransistors 101*a* to 101*d* and 102*a* to 102*d* are turned on, so that the outputs a and b of the latch circuits 105 and 106 become the High level, whereby the light emitting diode 128 (LED1) is lit. This causes the whole or one part of a first display area of the display panel shown in FIG. 26, to be illuminated.

When hands are inserted into the hand insertion unit 5 under this state, the infrared light beams from the inlet infrared light emitting diodes (inlet lower sensors 25) are first intercepted, and any of the four phototransistors 101*a* to 101*d* is turned off. This causes the outputs of the corresponding comparators 103*a* to 103*d* to become the Low level, so that the output a of the latch circuit 105 becomes the Low level. When the output a of the latch circuit 105 becomes the Low level, the output c of the AND circuit 107 becomes the Low level, and the output d of the AND circuit 108 becomes the High level. The Low level of the output c of the AND circuit 107 makes the light emitting diode 128 (LED1) unlit. The High level of the output d of the AND circuit 108 makes the output e of the timer circuit 110 the High level, so that the light emitting diode 129 (LED2) is lit, whereby the whole or one part of the second display area of the display panel shown in FIG. 26 is illuminated. In the second display area, an icon or characters for prompting the user to further insert the hands are illustrated.

When the user does not further insert the hands and this state remains unchanged for 2 seconds, the output e of the timer circuit 110 becomes the Low level, and the output f of the timer circuit 111 becomes the High level, thereby causing the light emitting diode 129 (LED2) to blink with the period of the oscillation circuit 116. When this state further continues for 5 seconds, the output f of the timer circuit 111 becomes the Low level, and the period of the oscillation circuit 116 is shortened, whereby the light emitting diode 129 (LED2) is caused through the AND circuit 114 to blink with a shorter period, so as to prompt the user to further insert the hands.

When the hands are inserted to the inner portion of the hand insertion unit 5, the infrared light beams from the inner infrared light emitting diodes (inner lower sensors 25) are intercepted, and any of the phototransistors 102*a* to 102*d* is turned off. This causes the outputs of the corresponding comparators 104*a* to 104*d* to become the Low level, so that the output b of the latch circuit 106 becomes the Low level. When the output b of the latch circuit 106 becomes the Low level, the output d of the AND circuit 108 becomes the Low level, so that the light emitting diode 129 (LED2) is unlit. Furthermore, the output h of the timer circuit 117 becomes the High level, whereby the light emitting diode 130 (LED3) is caused to blink with the period of the oscillation circuit 116, so that the whole or one part of a third display area of the display panel shown in FIG. 26 is illuminated in a blinking state. In the third display area, an icon or characters for prompting the user to slowly remove the hands are illustrated.

When a period of 2 seconds elapses, the output h of the timer circuit 117 becomes the Low level, and the output i of the timer circuit 118 becomes the High level, thereby causing the light emitting diode 130 (LED3) to be lit and the light emitting diode 131 (LED4) to blink so that the whole or one part of a fourth display area of the display panel shown in FIG. 26 is illuminated in a blinking state. In the fourth display area, an icon or characters for prompting the user to slowly remove the hands from the hand insertion unit 5 are illustrated. When a further period of 2 seconds elapses, the output i of the timer circuit 118 becomes the Low level, and the output j of the timer circuit 119 becomes the High level, thereby causing the light emitting diode 131 (LED4) to be unlit and the light emitting diode 132 (LED5) to blink so that the whole or one part of a fifth display area of the display panel shown in FIG. 26 is illuminated in a blinking state. In the fifth display area, an icon or characters indicating the completion of the process of drying hands are illustrated.

As described above, the hand dryer of the embodiment is provided with the inlet upper and lower sensors 25 and inner upper and lower sensors 25 for detecting the insertion of hands into the hand insertion unit 5, and the display unit 15 on which a guide to the operating procedure is displayed by illumination, using the light emitting diodes 128 to 132 (LED1 to LED5) that are lit or blinks in accordance with the detection states of the inlet upper and lower sensors 25 and inner upper and lower sensors 25. The above mentioned operation can be achieved by employing the microcomputer.

Namely, in the hand dryer of the embodiment, the upper and lower blowout nozzles 32 and 33 are respectively disposed in the upper and lower faces of the hand insertion unit 5 which is formed by opening the front and side faces of the case 6 so as to freely passing through. The high-pressure air generation device 7 supplies a high-pressure air flow to the blowout nozzles 32 and 33. The inlet upper and lower sensors 25 and inner upper and lower sensors 25 which are disposed in the hand insertion unit 5 detect the insertion state of hands into the hand insertion unit 5. On the display unit 15 disposed on the upper front face of the case 6, a guide to the operating procedure is displayed by illumination, using the light emitting diodes 128 to 132 (LED1 to LED5) which are lit or blink with predetermined time intervals.

Accordingly, simply by inserting hands into the hand insertion unit 5, the operating procedures are sequentially displayed on the display unit 15. Following the displayed instructions, anyone can use the hand dryer. As a result, even a person who uses the hand dryer for the first time can easily know the way to use it.

According to the hand dryer of the first aspect of the invention, a high-pressure air flow can be blown from the two faces in the case to the both sides of a hand. Therefore, the process of drying hands can be conducted within a short period while preventing water from scattering and splashing toward the user.

According to the hand dryer of the second aspect of the invention, nozzles which are respectively disposed in the opposing faces are shifted from each other. Therefore, the high- pressure air flows are prevented from interfering with each other, thereby improving the silence. In a configuration where blowing angles of the nozzles are different from each other according to the third aspect of the invention, the same effect can be attained.

According to the hand dryer of the fourth aspect of the invention, the speeds of air flows blown from the nozzles are different from each other. Therefore, the air can be blown out as required so that hands are efficiently dried. Also in the hand dryer of the fifth aspect of the invention, the velocity and pressure of the wind blown out from the nozzle can be controlled, thereby attaining the same effect.

According to the hand dryer of the sixth aspect of the invention, the air is circulated in the case. Therefore, water can be prevented from being blown toward the user, and the silence can be improved.

According to the hand dryer of the seventh aspect of the invention, a projection for guiding the air to the air inlet is provided. Therefore, there are effects that water can be further prevented from being scattered toward the user, and that the circulation efficiency is improved.

According to the hand dryer of the eight aspect of the invention, a filter is disposed so that a paper sheet, a handkerchief, and the like are prevented from clogging circulation. Therefore, the safety can be improved, and the dryer can be used more conveniently.

According to the hand dryer of the ninth aspect of the invention, the air circulation can cool the circuit substrate. Therefore, the circuit can be protected from overheating, and the high- pressure air to be blown to hands can be heated, thereby improving the efficiency.

According to the hand dryer of the tenth aspect of the invention, a sound barrier guides the air to the periphery of an air inlet hole of the high-pressure air flow generation device. Therefore, both the silence and the improvement in efficiency of the air flow can be attained.

According to the hand dryer of the eleventh aspect of the invention, the size of the inner portion of the hand insertion unit is greater than the inlet portion. Therefore, water can be prevented from being scattered toward the user, the user's indisposition to use the hand dryer can be mitigated, and the hand dryer can be thinned and miniaturized.

According to the hard dryer of the twelfth aspect of the invention the drainage holes are disposed at the side portions of the inner bottom face of the hand insertion unit. Therefore, the water is directed along the drainage holes by blown air from the nozzle so that the drainage can be conducted sanitarily and efficiently.

According to the hand dryer of the thirteenth aspect of the invention, the center portion of the inner bottom face of the hand insertion unit is protruded. Therefore, water blown from hands is directed to either of the sides to be drained, and hence the drainage can be conducted sanitarily and efficiently.

According to the hand dryer of the fourteenth aspect of the invention, a flange is formed at the opening portion, so that water is prevented by the flange from scattering, thereby improving the appearance.

According to the hand dryer of the fifteenth aspect of the invention, the high-pressure air flow generation device is disposed below the hand insertion unit. Therefore, the position of the center of gravity of the hand dryer can be lowered so as to improve the balance of the hand dryer. Furthermore, there is an effect that the hand dryer can be miniaturized.

According to the hand dryer of the sixteenth aspect of the invention, a drain sink is disposed below the said hand insertion unit. Therefore, there is an effect that an insanitary condition where water is discharged outside the case is prevented from occurring.

According to the hand dryer of the seventeenth aspect of the invention, when the sensor at the inner portion of the hand insertion unit detects hands, the high-pressure air flow is blown out, and, when the inlet sensor detects the nonexistence of hands, the blowout of the high-pressure air is stopped. When hands are to be dried, therefore, the user is requested only to slowly remove the hands from the hand insertion unit, so that the hands can be efficiently dried. Since the drying operation is not required to be continuously conducted while the hands are inserted into the hand insertion unit and kept unmoved, the user feels easy.

According to the hand dryer of the eighteenth aspect of the invention, the components are arranged in a predetermined order. Therefore, the operation of drying hands can be conducted efficiently and rationally.

According to the hand dryer of the nineteenth aspect of the invention, even when the sensor detects the nonexistence of hands, the high- pressure air is kept blown for a predetermined period. Even if the user slowly removes the hands from the hand insertion unit, the high-pressure air from the nozzle is kept blown until the hand completely withdrawn from the hand insertion unit so that the water can be removed from the fingers and the hand can be dried within a short period.

According to the hand dryer of the twentieth aspect of the invention, even when the sensor detects the nonexistence of hands, the high- pressure air is kept blown for a predetermined period. When, after the user once removes the hands from the hand insertion unit, the user is dissatisfied with the dried state and inserts again the hands into the hand insertion unit, the process of drying the hands can be immediately started, so that it is convenient to use and the hands can be dried within a short period.

According to the hand dryer of the twenty-first aspect of the invention, a display unit for a guide to the operating procedure is provided. Therefore, anyone using the hand dryer uniformly knows the operation state, whereby the high-pressure air is prevented from being uselessly blown out.

According to the hand dryer of the twenty-second aspect of the invention, even when the brightness of a lavatory or the like in which the hand dryer is installed is changed and the sensors are considerably affected, the sensors become less susceptible to malfunction. Even when the light intensity of a light emitting element is reduced owing to aging, the threshold is corrected, and therefore the element can conduct the normal sensing operation under the condition of a reduced light intensity. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hand dryer comprising:

a case;

a hand insertion unit which is disposed in said case, which opens at the front and side faces of said case and which has a bottom face between two opposing faces of the hand insertion unit, and into which hands can obliquely be inserted through the opening and between the two opposing faces, said unit having a size sufficient for accommodating hands;

a high-pressure air flow generation device which is disposed in said case, and which has a fan for generating a high-pressure air flow; and nozzles which are respectively disposed in the two opposing faces of said hand insertion unit, said nozzles communicating with an air flow path of said high-pressure air flow generation device and being located above the bottom face of the hand insertion unit, said nozzles release air at a velocity of 50 to 150 m/sec.

2. The hand dryer according to claim 1, wherein said nozzles are respectively disposed in the opposing faces of said hand insertion unit while being shifted from each other, so that said nozzles are not directly opposed to each other.

3. The hand dryer according to claim 1, wherein blowing angles of said nozzles are different from each other.

4. The hand dryer according to claim 1, wherein the speeds of air flows blown from said nozzles are different from each other.

5. The hand dryer according to claim 1, wherein the bore diameters of holes of said nozzles are different from each other.

6. The hand dryer according to claim 1, wherein an air inlet is formed in a face which constitutes said hand insertion unit, and an air duct is disposed, said air duct forming a path through which the air circulates from said air inlet to said high-pressure air flow generation device.

7. The hand dryer according to claim 6, wherein, in said face in which said air inlet is formed and which constitutes said hand insertion unit,a projection for guiding the air to said air inlet is disposed in front of said air inlet.

8. The hand dryer according to claim 1, wherein an air inlet for circulating the air to said high-pressure air flow generation device is disposed in a face of said hand insertion unit, said air inlet being beneath said nozzles, a filter having a large number of holes through which the air can pass being disposed so as to cover said air inlet.

9. The hand dryer according to claim 6, wherein a circuit portion for controlling said high-pressure air flow generation device is located in a part of said air flow path in which air to be supplied to said high-pressure air generation device is flowing.

10. The hand dryer according to claim 1, wherein a sound barrier is disposed at the periphery of an air inlet hole through which the air is sucked into said high-pressure air flow generation device.

11. The hand dryer according to claim 1, wherein the size of the inner portion of said hand insertion unit is greater than the inlet portion of said hand insertion unit.

12. The hand dryer according to claim 1, wherein drainage holes for guiding water to the outside of said hand insertion unit are disposed at side portions of the inner bottom face of said hand insertion unit.

13. The hand dryer according to claim 1, wherein the center portion of the inner bottom face of said hand insertion unit is protruded to form inclinations at both sides of said center portion, and drainage holes for guiding water to the outside of said hand insertion unit are disposed at the deepest portions of said inclinations.

14. The hand dryer according to claim 1, wherein a flange is formed at the periphery forming the opening of the inlet portion of said hand insertion unit.

15. The hand dryer according to claim 1, wherein said hand insertion unit is disposed at the upper portion of said case, and said high-pressure air flow generation device is disposed below said hand insertion unit.

16. The hand dryer according to claim 1, wherein a drain sink which communicates with said hand insertion unit is disposed below said hand insertion unit, said drain sink being able to store water.

17. The hand dryer according to claim 1, wherein sensors for detecting the insertion state of hands into said hand insertion unit are respectively disposed at the inlet and inner portions of said hand insertion unit, and, when the sensor at the inner portion detects the existence of hands, said high-pressure air flow generation device is operated, and, when the sensor at the inlet portion detects the nonexistence of hands, the operation of said high-pressure air flow generation device is stopped.

18. The hand dryer according to claim 4, wherein a sensor for detecting the existence of hands, and for actuating said high-pressure air flow generation device is disposed on the inner wall of said hand insertion unit, said sensor, said air inlet, and said nozzles being arranged in this sequence starting from the inlet of said hand insertion unit.

19. The hand dryer according to claim 1, wherein said hand dryer further comprises:

a sensor which is disposed in said hand insertion unit and which detects the insertion state of hands into said hand insertion unit; and operation controlling means for, in response to the detection by said sensor, starting the operation of said high-pressure air flow generation device, and for stopping the operation of said high-pressure air flow generation device, when a predetermined period has elapsed after said sensor entered into the nondetection state.

20. The hand dryer according to claim 1, wherein said hand dryer further comprises:

sensors which are respectively disposed at the inlet and inner portions of said hand insertion unit, and which detect the insertion state of hands into said hand insertion unit; and operation controlling means for causing said high-pressure air generation device to operate at a high speed, in the case where said sensor at the inlet portion is in the detection state even when said sensor at the inner portion is changed from the detection state to the nondetection state, for causing said high-pressure air flow generation device to operate at a high speed, in response to only the detection of said sensor at the inlet portion, during a predetermined period after the stop of the operation of said high-pressure air flow generation device, and for causing said high-pressure air flow generation device not to operate at high speed, in response to the detection of said sensor at the inlet portion, when the predetermined period has elapsed after the step of the operation of said high-pressure air flow generation device.

21. The hand dryer according to claim 1, wherein said hand dryer further comprises:

a sensor which is disposed in said hand insertion unit and which detects the insertion state of hands into said hand insertion unit; and a display unit which is disposed at the upper portion of said hand insertion unit, and which, in response to the detection of said sensor, displays a guide to the operating procedure by illumination, using light emitting elements which are operated at predetermined time intervals.

22. The hand dryer according to claim 1 further comprising:

infrared sensors each having a light emitting element and a light receiving element which are respectively disposed at opposing positions of faces of said hand insertion unit, said faces opposing to each other, said light receiving element detecting a light from said light emitting element and other lights from other than said light emitting element;

means for controlling said high-pressure air flow generation device in accordance with a comparison of the output of said infrared sensors and a predetermined value; and means for correcting said predetermined value in accordance with said detection result.

23. The hand dryer according to claim 1, further comprising a circuit box operatively connected to the high-pressure air flow generation device, a portion of the air flow generated by the high-pressure air flow generation device passing the circuit box, the circuit box being the only source of heat for the air flow from the nozzles.

24. The hand dryer according to claim 1, wherein the air is directed generally downwardly toward the bottom face of the hand insertion unit.

25. The hand dryer according to claim 1, wherein an interior of the hand insertion unit between the nozzles is open and free of obstructions and wherein the hand insertion unit has a depth to thereby accommodate insertion of a majority of both hands of a user therein.

26. The hand dryer comprising:

a case;

a hand insertion unit which is disposed in said case, which opens at the front and side faces of said case and which has a bottom face between two opposing faces of the hand insertion unit, and into which hands can obliquely be inserted through the opening and between the two opposing faces, said unit having a size sufficient for accommodating hands, drainage holes for guiding water to the outside of said hand insertion unit being disposed at side portions of an inner bottom face of said hand insertion unit;

a high-pressure air flow generation device which is disposed in said case, and which has a fan for generating a high-pressure air flow; and nozzles which are respectively disposed in the two opposing faces of said hand insertion unit, said nozzles communicating with an air flow path of said high-pressure air flow generation device and being located above the bottom face of the hand insertion unit.

27. The hand dryer according to claim 26, wherein a drain sink communicates with said hand insertion unit, the drain sink being disposed below said hand insertion unit and being able to store water.

28. The hand dryer according to claim 26, further comprising:

a sensor disposed in said hand insertion unit for detecting an insertion state of hands into said hand insertion unit; and operation controlling means for, in response to the detection by said sensor, starting the operation of said high-pressure air flow generation device, when a predetermined period has elapsed after said sensor enters into the nondetection state.

29. The hand dryer according to claim 26, further comprising:

sensors which are respectively disposed at the inlet and inner portions of said hand insertion unit and which detect the insertion state of hands into said hand insertion unit; and operation controlling means for causing said high-pressure air generation device to operate at a high speed, when said sensor at the inlet portion is in the detection state even when said sensor at the inner portion is changed from the detection state to the nondetection state, for causing said high-pressure air flow generation device to operate at a high speed, in response to only the detection of said sensor at the inlet portion, during a predetermined period after the stop of the operation of said high-pressure air flow generation device, and for causing said high-pressure air flow generation device not to operate at high speed, in response to the detection of said sensor at the inlet portion, when the predetermined period has elapsed after the stop of the operation of said high-pressure air flow generation device.

30. The hand dryer according to claim 26, further comprising:

a sensor disposed in said hand insertion unit for detecting an insertion state of hands into said hand insertion unit; and a display unit which is disposed at the upper portion of said hand insertion unit, and which, in response to the detection of said sensor, displays a guide to the operating procedure by illumination, using light emitting elements which are operated at predetermined time intervals.

31. The hand dryer according to claim 26, further comprising:

infrared sensors each having a light emitting element and a light receiving element which are respectively disposed at opposing positions of faces of said hand insertion unit, said faces opposing to each other, said light receiving element detecting a light from said light emitting element and other lights from other than said light emitting element;

means for controlling said high-pressure air flow generation device in accordance with a comparison of the output of said infrared sensors and a predetermined value; and means for correcting said predetermined value in accordance with said detection result.

32. The hand dryer according to claim 26, further comprising a circuit box operatively connected to the high-pressure air flow generation device, a portion of the air flow generated by the high-pressure air flow generation device passing the circuit box, the circuit box being the only source of heat for the air flow from the nozzles.

* * * * *